US010563439B2

(12) United States Patent
Miglioranzo

(10) Patent No.: US 10,563,439 B2
(45) Date of Patent: Feb. 18, 2020

(54) CONCEALED HINGE FOR DOORS

(71) Applicant: Ivano Miglioranzo, Valeggio sul Mincio (IT)

(72) Inventor: Ivano Miglioranzo, Valeggio sul Mincio (IT)

(73) Assignee: OL MI S.R.L., Castelnuovo del Garda (IT)

( * ) Notice: Subject to any disclaimer, the term of this patent is extended or adjusted under 35 U.S.C. 154(b) by 101 days.

(21) Appl. No.: 15/713,888

(22) Filed: Sep. 25, 2017

(65) Prior Publication Data

US 2018/0010373 A1 Jan. 11, 2018

Related U.S. Application Data

(63) Continuation of application No. PCT/IB2016/051708, filed on Mar. 25, 2016.

(51) Int. Cl.
*E05D 7/04* (2006.01)
*E05D 3/18* (2006.01)

(52) U.S. Cl.
CPC ..... *E05D 7/04* (2013.01); *E05D 3/186* (2013.01); *E05Y 2600/41* (2013.01); *E05Y 2900/132* (2013.01); *Y10T 16/53864* (2015.01)

(58) Field of Classification Search
CPC ..... E05D 7/04; E05D 7/0407; E05D 7/0423; E05D 3/186; E05D 3/142; E05D 3/183; E05Y 2600/41; E05Y 2900/132; Y10T 16/53864; Y10T 16/5383; Y10T 16/53832; Y10T 16/53833; Y10T 16/53225; Y10T 16/53253; Y10T 16/544
USPC ..... 16/302, 286, 287, 288, 238, 245, 357
See application file for complete search history.

(56) References Cited

U.S. PATENT DOCUMENTS

| | | | | |
|---|---|---|---|---|
| 882,721 | A | 3/1908 | Soss | |
| 2,709,276 | A | 5/1955 | Stein | |
| 4,102,006 | A | 7/1978 | Jenkins | |
| 9,803,410 | B2 * | 10/2017 | Miglioranzo | E05D 3/186 |
| 2007/0294860 | A1 | 12/2007 | Hoffman | |

(Continued)

FOREIGN PATENT DOCUMENTS

| | | | |
|---|---|---|---|
| CN | 201363034 Y | * | 12/2009 |
| CN | 207177554 U | * | 4/2018 |

(Continued)

*Primary Examiner* — William L Miller
(74) *Attorney, Agent, or Firm* — Mark David Torche; Patwrite Law

(57) ABSTRACT

A concealed hinge for the rotatable movement of a door fixed to a door frame. The hinge includes: a fixed hinge body anchorable to the frame; a movable hinge body anchorable to the door; a connecting assembly for mutual connection of the fixed hinge body and movable hinge body so that the latter rotates with respect to the former about a first longitudinal axis between an open position and closed position. The fixed (or movable) hinge body includes a first (or second) box-shaped element concealedly insertable within the door (or frame). The first (or second) box-shaped element defines a second axis parallel to the first axis. The connecting assembly protrudes from the first box-shaped element in the open position of the movable element, the first box-shaped element being susceptible to internally contain the connecting assembly in the closed position of the movable element.

18 Claims, 16 Drawing Sheets

(56) References Cited

U.S. PATENT DOCUMENTS

| | | | | |
|---|---|---|---|---|
| 2010/0122431 | A1* | 5/2010 | Neukoetter | E05D 3/186 16/238 |
| 2013/0067686 | A1* | 3/2013 | Migliorini | E05D 3/16 16/298 |
| 2016/0032636 | A1* | 2/2016 | Dai | E05F 5/006 16/65 |
| 2017/0016261 | A1* | 1/2017 | Miglioranzo | E05F 3/102 |
| 2019/0071904 | A1* | 3/2019 | Migliorini | E05D 11/0054 |
| 2019/0071905 | A1* | 3/2019 | Migliorini | E05D 3/16 |
| 2019/0071906 | A1* | 3/2019 | Migliorini | E05D 3/16 |

FOREIGN PATENT DOCUMENTS

| | | | | | |
|---|---|---|---|---|---|
| CN | 109098576 | A | * | 12/2018 | |
| DE | 20213336 | U1 | * | 11/2002 | E05D 3/186 |
| DE | 102007031175 | B3 | | 10/2008 | |
| DE | 102015116192 | B3 | * | 4/2016 | E05D 7/0415 |
| EP | 2110502 | A2 | * | 10/2009 | E05D 3/186 |
| EP | 2754807 | A1 | * | 7/2014 | E05D 3/186 |
| GB | 1252757 | A | | 11/1971 | |
| GB | 2503753 | A | | 1/2014 | |
| JP | 2002121955 | A | | 4/2002 | |
| WO | WO-2013179326 | A1 | * | 12/2013 | E05D 3/186 |
| WO | WO-2018030883 | A1 | * | 2/2018 | E05D 3/186 |

* cited by examiner

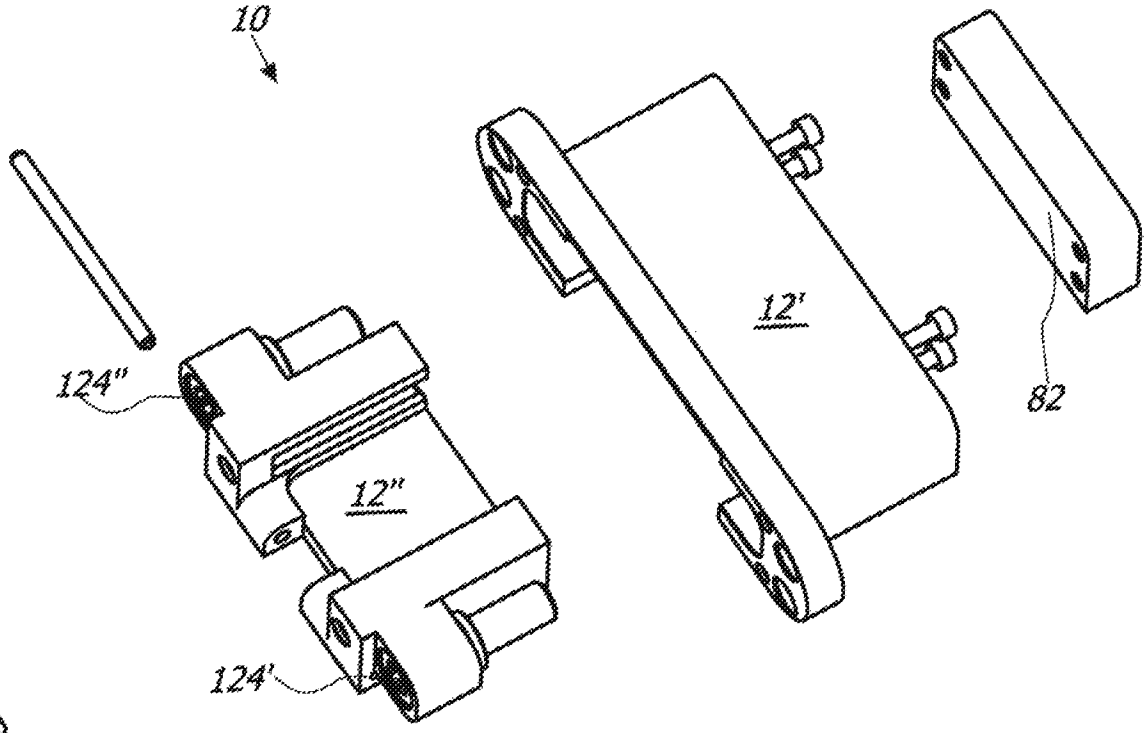
FIG. 14
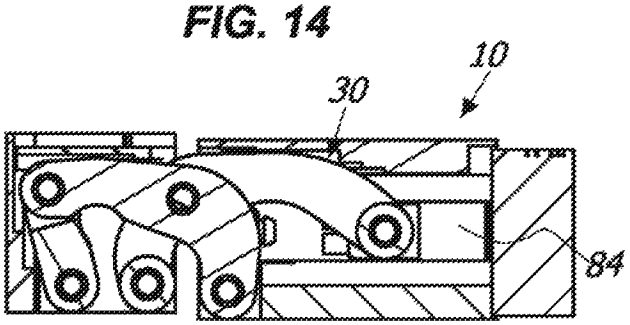
FIG. 15
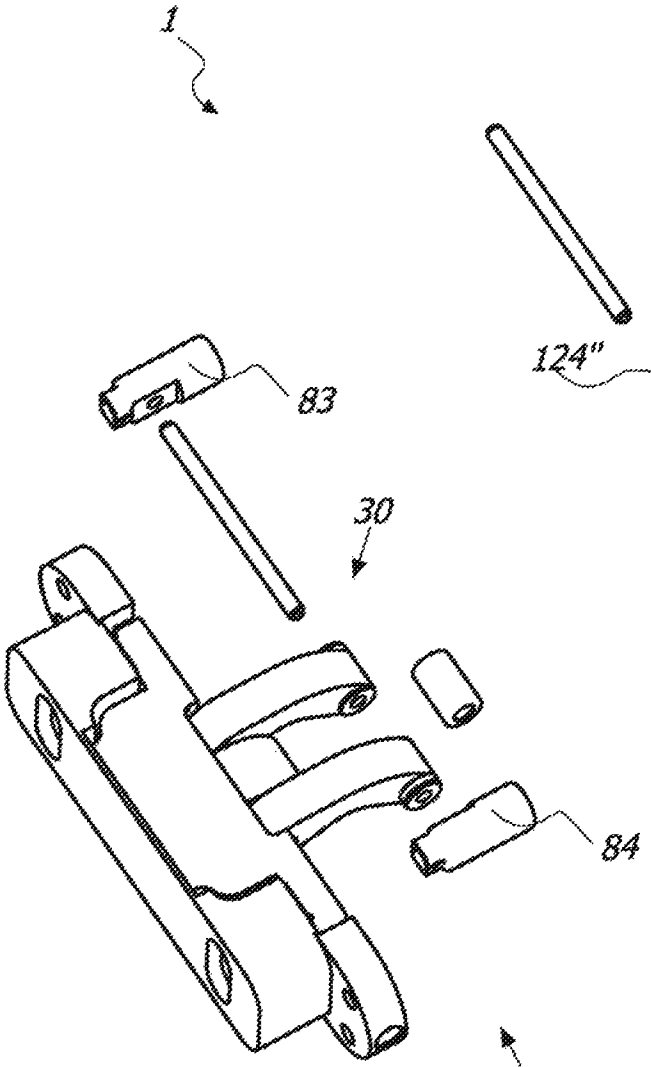

CONCEALED HINGE FOR DOORS

CROSS REFERENCE TO RELATED APPLICATIONS

This application is a continuation of PCT Application Number PCT/IB2016/051708, filed Mar. 25, 2016 which in turn claims priority to PCT/IB2015/052183, filed Mar. 25, 2015, the complete disclosures of each of which are hereby incorporated by reference.

FIELD OF INVENTION

The present invention is generally applicable in the technical field of hinges, and particularly relates to a concealed hinge for doors.

BACKGROUND OF THE INVENTION

Hinges are known which comprise a fixed hinge body to be concealedly embedded in a wall, a movable hinge body to be anchored to a door and a connection assembly for mutual connection of the fixed hinge body and the movable one. In this way, the movable hinge body rotates with respect to the fixed one around a vertical axis between an open door position and a closed door position.

The fixed hinge body includes a generally box-shaped element susceptible to internally contain the connection assembly of when the movable hinge body is in the closed door position. The connection assembly protrudes from the box-shaped element when the movable hinge body is in the open door position.

The concealed hinges of the type mentioned above available today on the market does not allow the control of the closing element during opening and/or closing.

They are further bulky and include a large number of parts.

Another drawback is the poor safety of such hinges, due to the fact that the doors to which are connected if pushed by a careless user is free to strongly impact against the frame to which they are anchored.

From the documents GB1252757, U.S. Pat. No. 4,102,006, GB2503753, U.S. Pat. No. 882,721, DE102007031175, US2007/294860 and U.S. Pat. No. 2,709,276 concealed hinges are known.

SUMMARY OF THE INVENTION

The object of the present invention is to overcome at least partly the above mentioned drawbacks, by providing a hinge having characteristics of high functionality and low cost.

Another object of the invention is to provide a hinge of limited dimensions.

Another object of the invention is to provide a hinge that is capable of supporting also very heavy doors, without changing the behavior.

Another object of the invention is to provide a hinge which has a minimum number of constituent parts.

Another object of the invention is to provide a hinge capable of maintaining the exact closing position over time.

Another object of the invention is to provide a safe hinge.

Another object of the invention is to provide a hinge easy to install.

The above objects, as well as others that will appear more clearly hereinafter, are achieved by a hinge according to which is herein described and/or shown and/or claimed.

Advantageous embodiments of the invention are defined according to the dependent claims.

BRIEF DESCRIPTION OF THE DRAWINGS

Further features and advantages of the invention will appear more evident upon reading the detailed description of a preferred, non-exclusive embodiment of a hinge 1, which is described as non-limiting example with the help of the annexed drawings, wherein:

FIG. 14 is an exploded isometric view of a further embodiment of the hinge 1;

FIG. 15 is a sectioned view of the embodiment of the hinge 1 of FIG. 14 in the closed position;

DETAILED DESCRIPTION OF THE INVENTION

With reference to the above figures, the hinge 1 is advantageously to be used for the rotatable movement of a door, during both opening and closing thereof.

In general, the embodiments of the hinge 1 according to the FIGS. 1 to 13 may be used for hydraulically closing and/or opening and/or checking any closing element, such as a door, a window, a shutter or the like, anchored to any stationary support structure, such as a wall, a floor, a frame or the like, without departing from the scope of the appended claims.

On the other side, the embodiment of the hinge 1 according to the FIGS. 14 and 15 may be used to mechanically connect the closing element and the stationary support structure.

In particular, the hinge 1 may be of the concealed type and can be advantageously used with an internal door D, for example a wooden door, supported by a frame F.

Essentially, the hinge 1 may include a fixed hinge body 20, a movable hinge body 10 and a connection assembly, indicated generally with 30, for mutual connection thereof.

Figure 1:
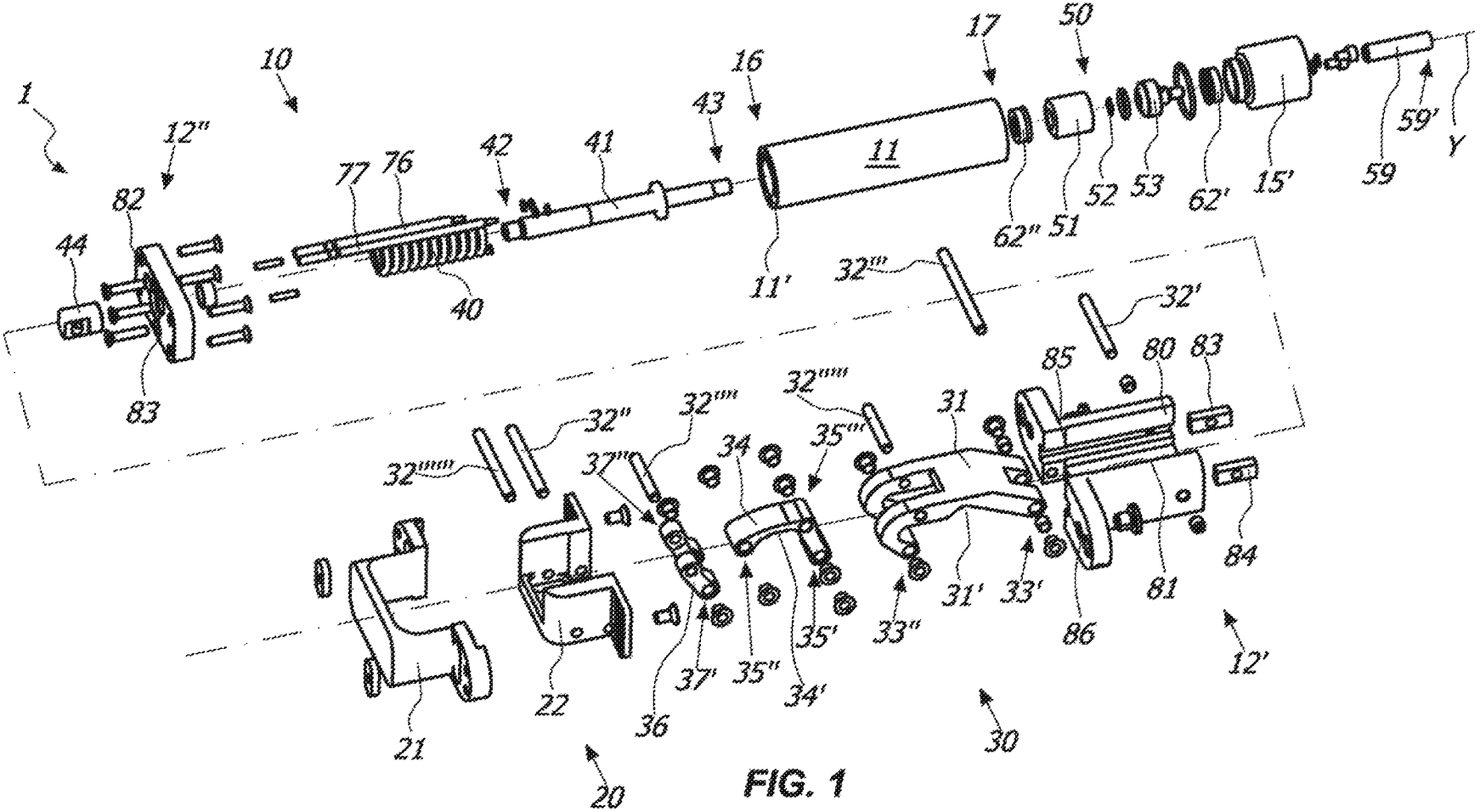
FIG. 1 is an exploded isometric view of an embodiment of the hinge 1.
Figure 2A:
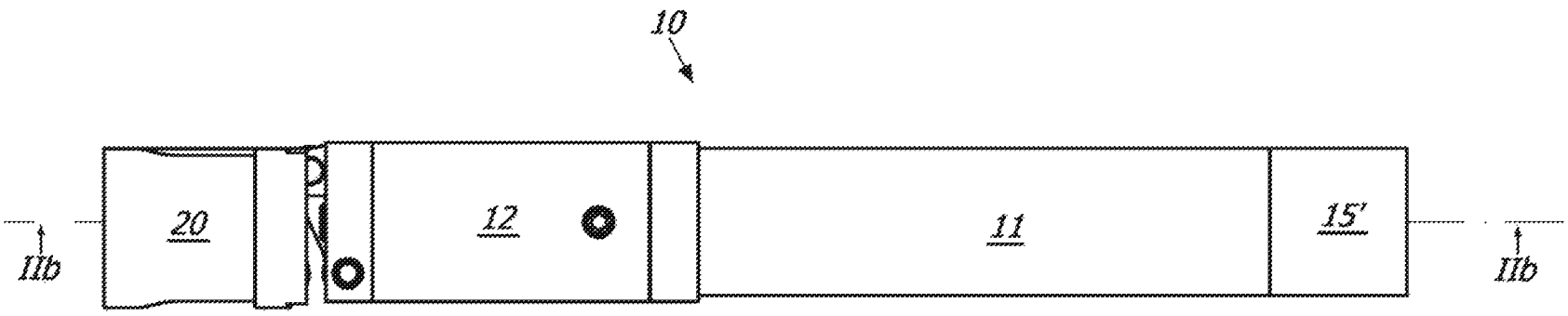
FIGS. 2*a*, 2*b* and 2*c* are views respectively top, sectioned along a plane IIb-IIb and partially sectioned along a plane perpendicular to the plane IIb-IIb of the embodiment of the hinge 1 of FIG. 1 in the closed position.
Figure 2B:
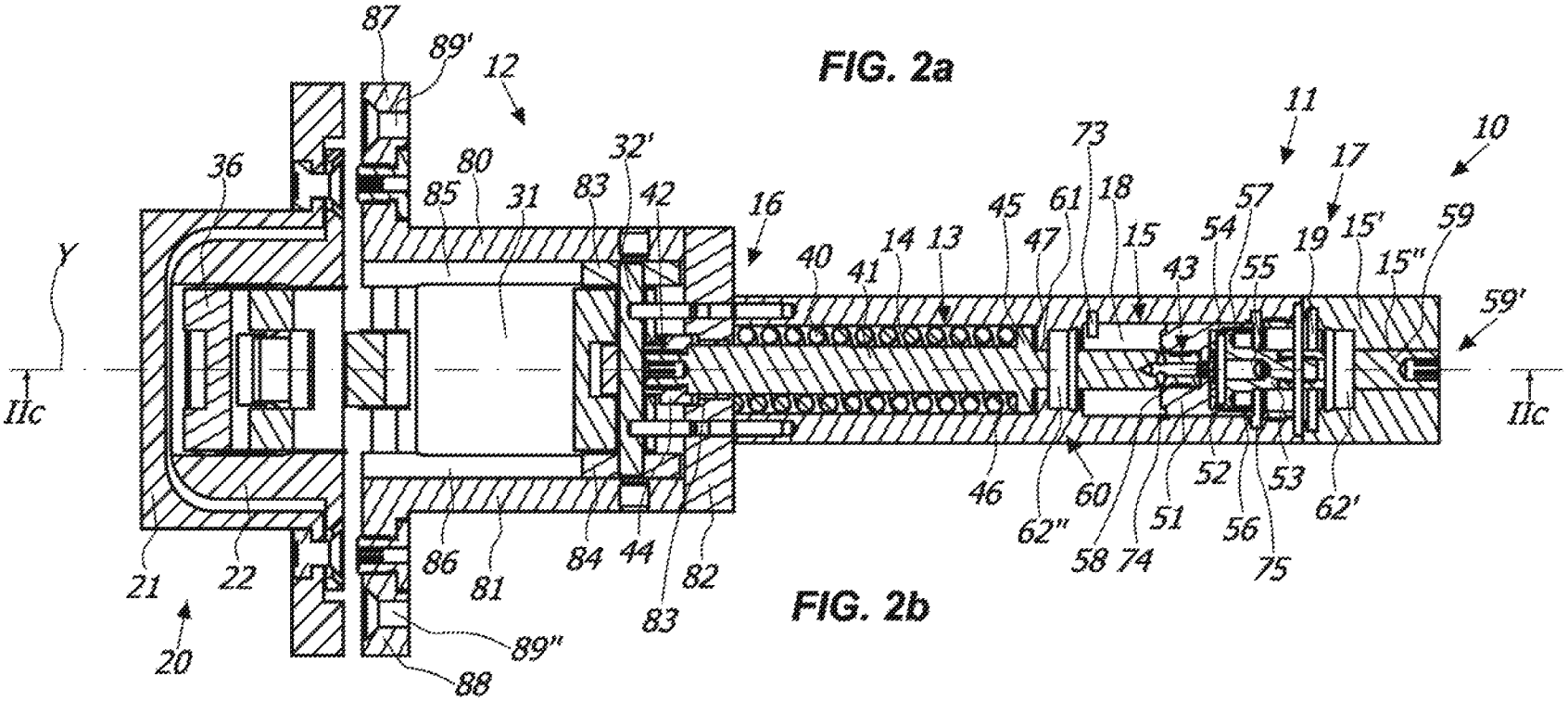
Figure 2C:
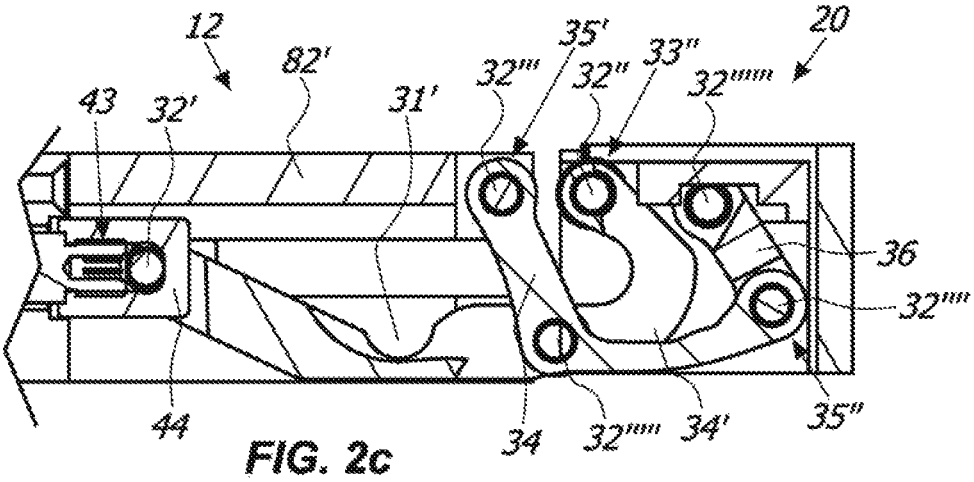
Figure 4C:
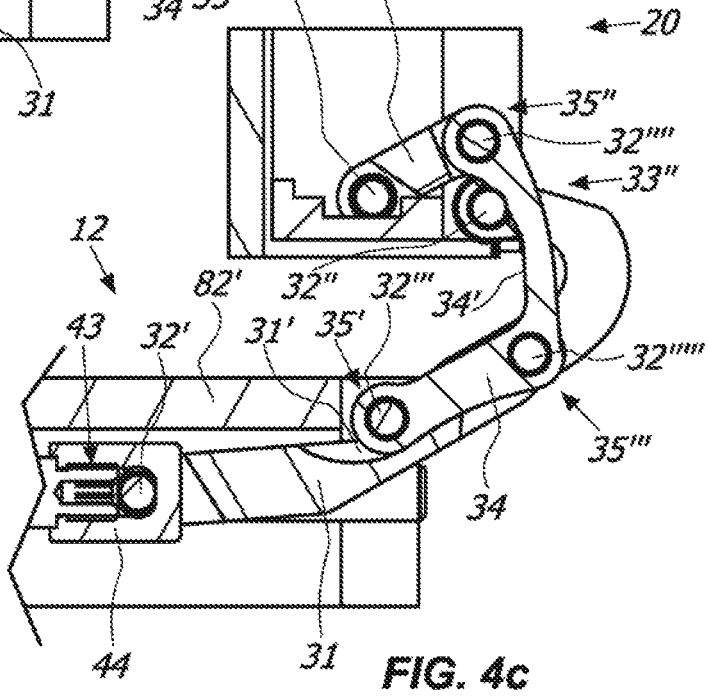
FIGS. 4*a*, 4*b* and 4*c* are views respectively top, sectioned along a plane IVb-IVb and partially sectioned along a plane perpendicular to the plane IVb-IVb of the embodiment of the hinge 1 of FIG. 1 in the fully open position at 180°.

As a result of this connection, the movable hinge body 10 rotates with respect to the fixed one 20 around a longitudinal axis X, which may be substantially vertical, between an open door position, shown for example in FIGS. 3*a* to 4*c*, and a closed door position, shown for example in FIGS. 2*a* and 2*b*.

Suitably, the fixed hinge body 20 may be concealedly embedded within the frame F that acts as a stationary support for the door D. On the other hand, the movable hinge body 10 may be connected to the door D.

However, the opposite is possible, that is the fixed hinge body 20 may be anchored to the wall and the movable one 10 may be concealedly embedded within the door, without departing from the scope of the appended claims.

Advantageously, in the embodiments according to the FIGS. 1 to 13 the movable hinge body 10 may include a tubular member 11 defining an axis Y substantially perpendicular to the axis X and a first box-shaped element 12 susceptible to contain in its interior the connection assembly 30 when the movable hinge body 10 is in the door closed position, as shown for example in FIG. 2*a*.

It is understood that the tubular element 11 may also belong to the hinge body 20, as well as that the hinge 1 can include more than one tubular element 11, without departing from the scope of the appended claims.

It is also understood that the tubular element 11 may have any shape, for example a cylindrical or parallelepiped shape with square or rectangular section, provided that it is internally hollow.

Figure 3C:
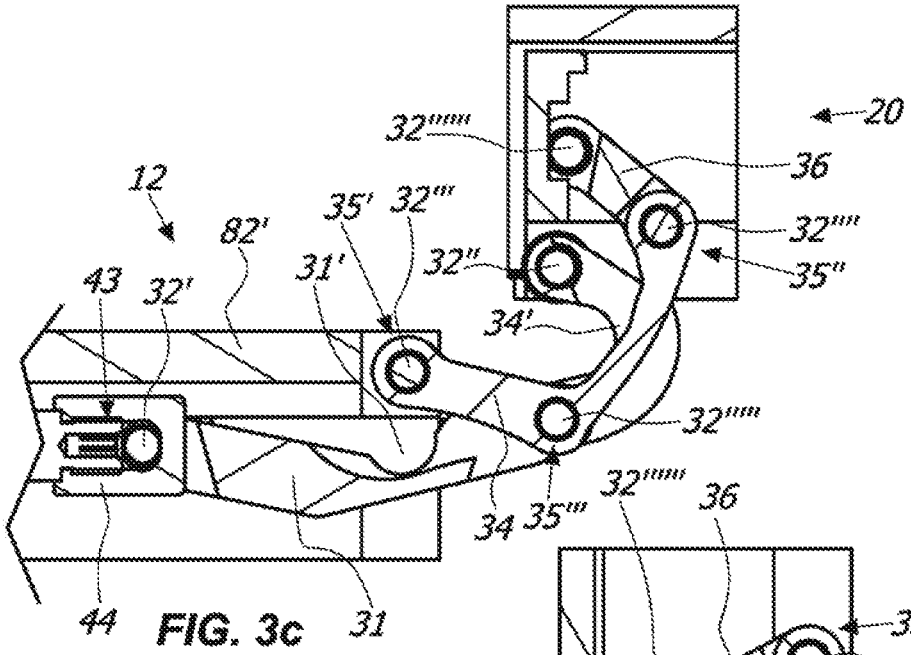
FIGS. 3*a*, 3*b* and 3*c* are views respectively top, sectioned along a plane IIIb-IIIb and partially sectioned along a plane perpendicular to the plane IIIb-IIIb of the embodiment of the hinge 1 of FIG. 1 in a partially open position.
Figure 3A:
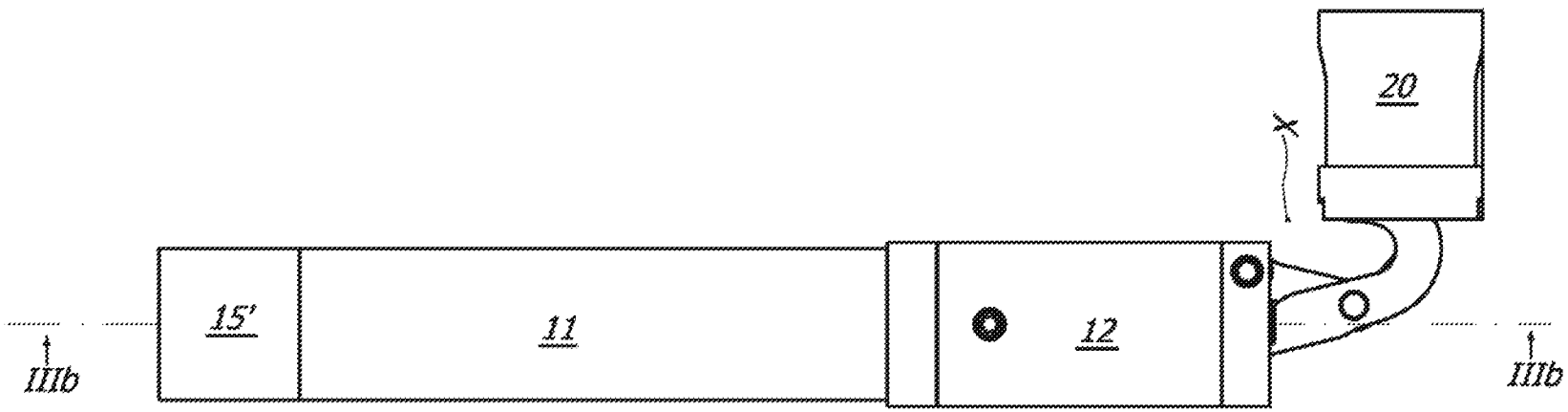
Figure 3B:
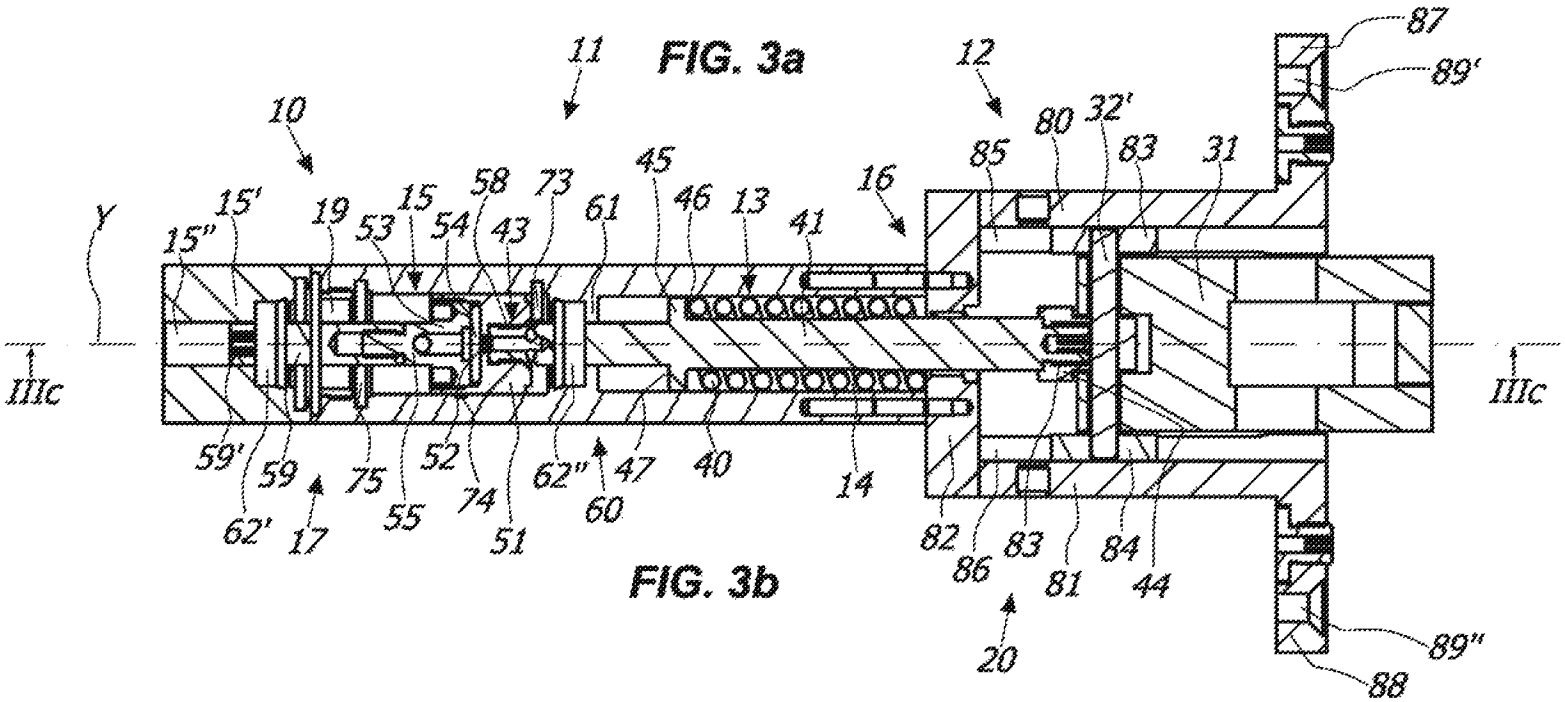
Figure 4A:
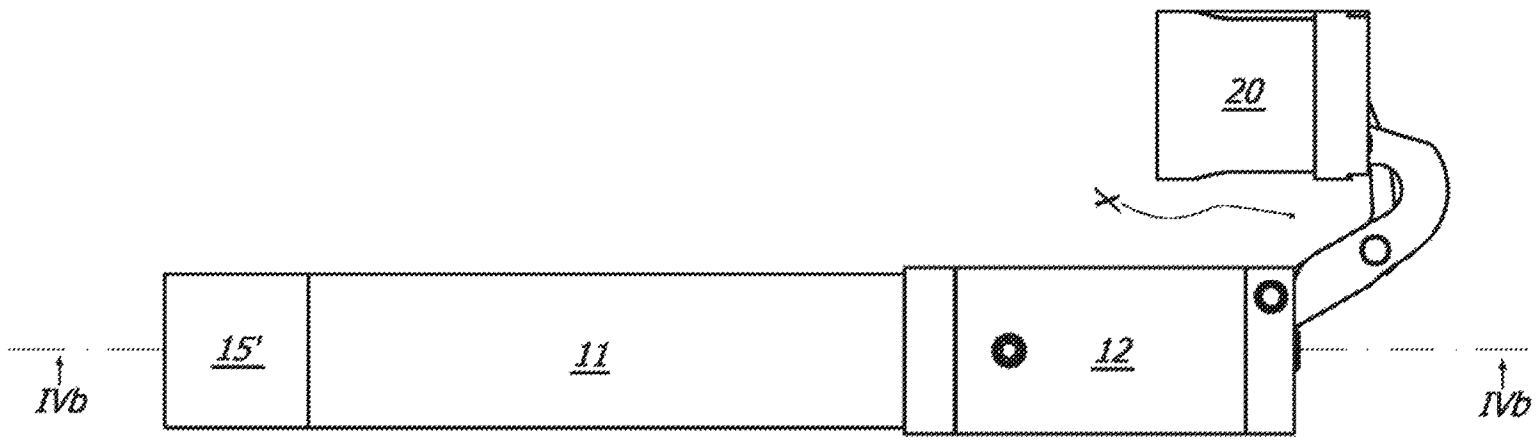
Figure 4B:
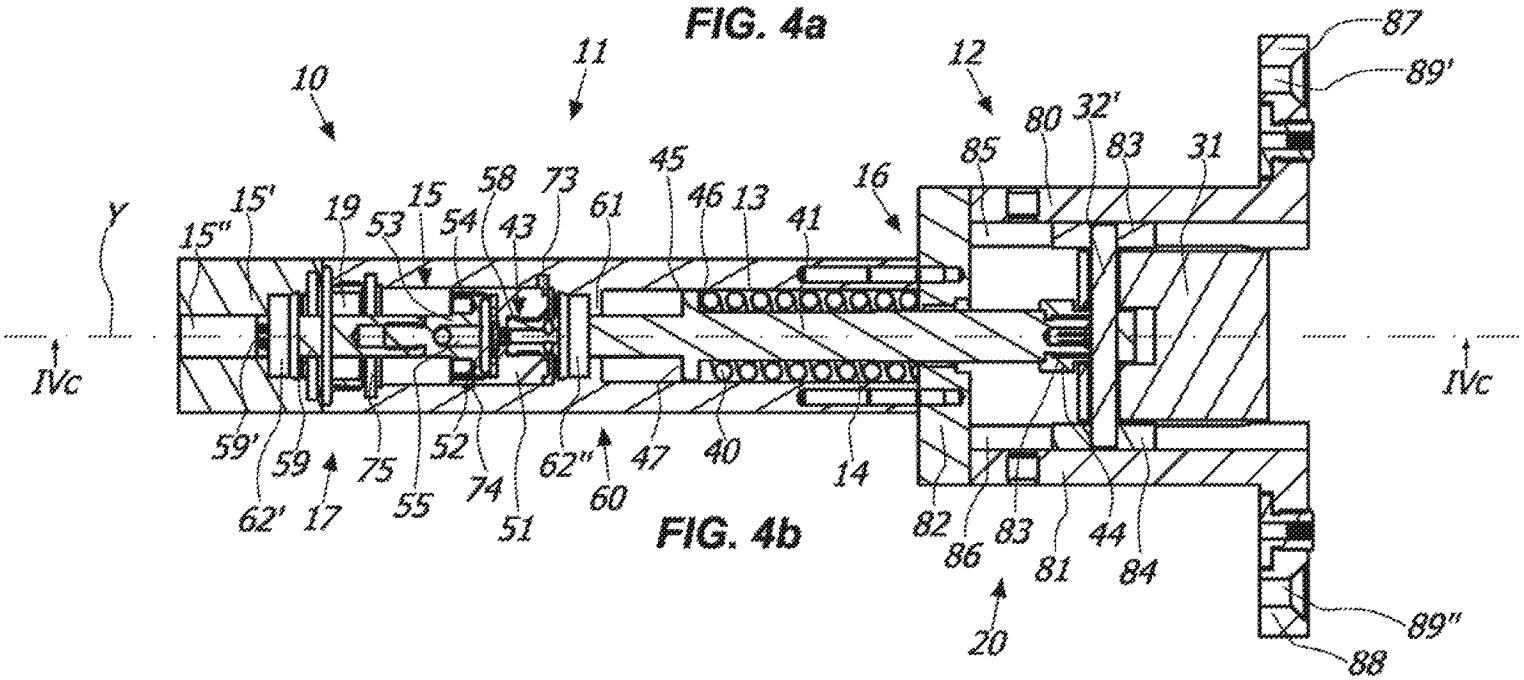
Figure 5A:
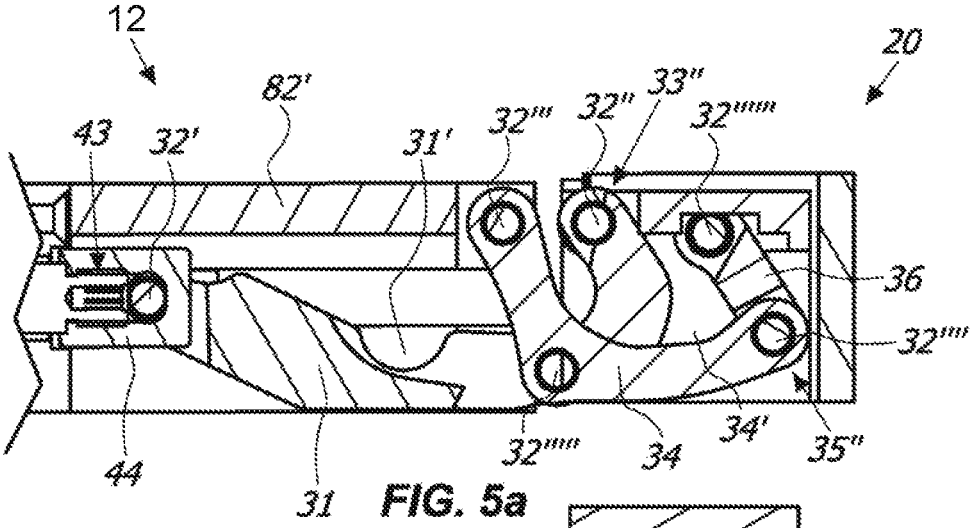
FIGS. 5*a*, 5*b* and 5*c* are partially sectional views similar to FIGS. 2*c*, 3*c* and 4*c* of an alternative embodiment of the hinge 1 that in the fully open position reaches 155°.
Figure 5B:
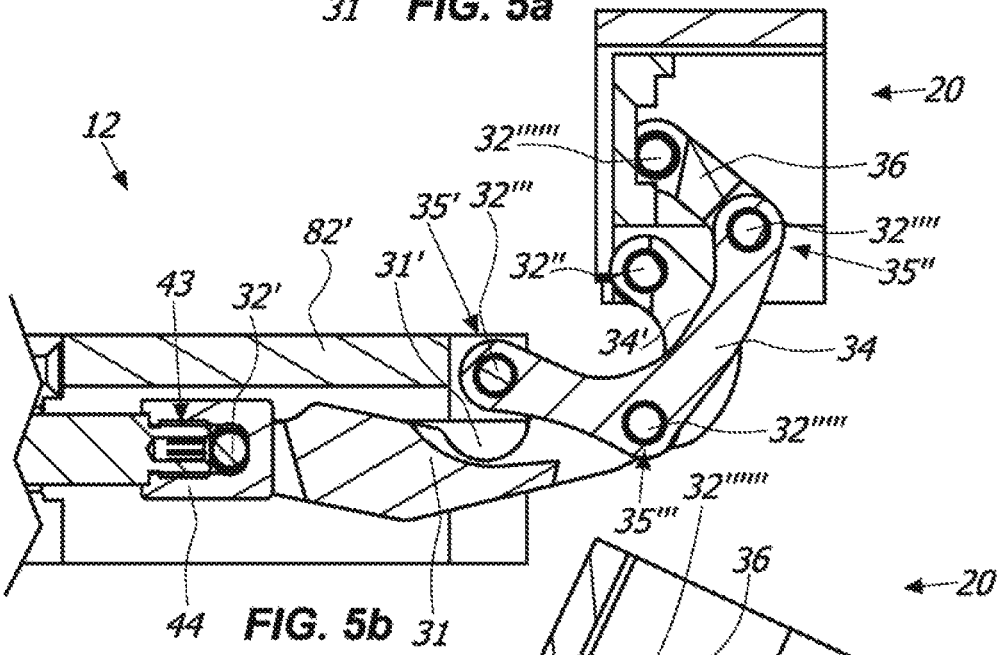
Figure 5C:
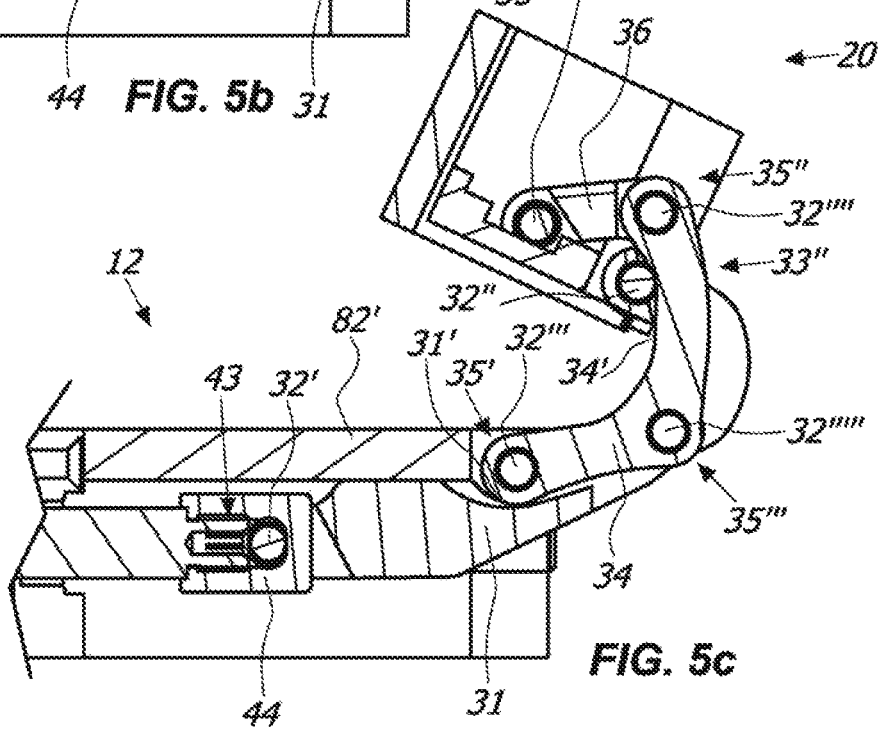

The connection assembly 30 is further configured to protrude from the first box-shaped element 12 when the movable hinge body 20 is in the open door position, as shown for example in FIGS. 3*a* and 4*a*. The particular configuration of the connection assembly 30 is described later.

It is understood that the hinge 1 may have a different configuration, provided however that it includes a fixed element and a movable element coupled each other to rotate around an axis, without departing from the scope of the appended claims. The fixed and movable elements may be coupled in any manner, for example by a pivot.

The fixed hinge body 20 may include a second box-shaped element formed by a first outer element 21 and a second element 22 internal thereto, the latter cooperating with each other. The fixed hinge body 20 can be designed to be concealedly embedded within the door D or the frame F.

In some preferred but not exclusive embodiments, shown for example in FIGS. 8 to 12*d* and in FIGS. 14 and 15, the first outer element 21 may include first guide means for guiding the sliding of the second inner element 22 along a direction d which is substantially perpendicular to the axis X and the axis Y.

It is understood that in the embodiments which do not include the tubular element 11 the axis Y may be defined by the fixed hinge body 20 concealedly embedded within the frame F.

To do this, the first outer element 21 may include a pair of first grooved surfaces 121 with a plurality of rows defining the direction d, while the second inner element 22 may include at least one corresponding pair of second counter-shaped surfaces 122 engaged with the first surfaces 121, which surfaces define the first guide means.

The grooved surfaces 121, the counter-shaped surfaces 122 and a pair of screw elements 123', 123" designed for mutually engaging/disengaging thereof may define means for reciprocally blocking/unblocking the first outer element 21 and the second inner element 22.

Advantageously, each of the screw elements 123', 123" may include a respective screw 124', 124" to be engaged in a corresponding engagement element 125', 125" sliding in a respective elongate slot 126', 126", the latter being placed on surfaces 127', 127" opposite to the second counter-shaped surfaces 122.

In a preferred but not exclusive embodiment, the screws 124', 124" may be inserted through respective slots 129', 129" passing-through the second inner element 22 and through a second hole 130', 130" passing-through the first outer element 21. The slots 129', 129" may be substantially parallel to the axis X, so as to allow the second inner element 22 to slide vertically.

Suitably, the first outer element 21 may include second guide means for guiding the sliding of the second inner element 22 along a direction d' substantially parallel to the axis X and perpendicular to both the axis Y and to the direction d. The second guide means may include two or more adjusting screws 128', 128" placed at opposite sides of the second inner element 22.

The adjusting screws 128', 128" may be inserted through the first outer element 21 to interact with the second inner element 22.

In order to allow an operator to operate on the adjusting screws 128', 128", the first outer element 21 and/or the second inner element 22 may include two or more front apertures 131', 131" in correspondences of the adjusting screws 128', 128". In this manner, an operator can easily access the latter when the second box-shaped element 20 is concealedly inserted within the stationary support structure, i.e. when the closing element D is mounted on the frame F.

Suitably, each of the adjusting screws 128', 128" may include one or more seats 132', 132" to be engaged by a suitable adjusting tool, e.g. a wrench, through said front apertures 131', 131".

During use, the second guide means may be operable by an operator upon mutual disengagement of the surfaces 121 and 122 by acting on the screws 124', 124". After operation, the latter may be mutually reengaged.

It is understood that the adjusting screw 128' may support the second inner element 22 during the sliding thereof along the direction d.

The box-shaped element 12 can be formed by a first outer element 12' and a second element 12" internal thereto, the latter being mutually coupled each other. As a whole, the box-shaped element 12 may define a hollow body with a pair of upper and lower walls 80, 81 substantially parallel to the axis Y joined by a side wall 82' and a bottom wall 82, the latter being substantially perpendicular to the side wall 82' and the axis Y.

More particularly, the upper and lower walls 80, 81 and the side wall 82' belong to the first outer element 12', while the bottom wall 82 may be a plate attached thereto.

In use, the side wall 82', the upper and lower walls 80, 81 and the bottom wall 82 are susceptible to be concealed within the door or the wall, their inner side being however accessible from the outside. More precisely, if necessary, an operator can access from the outside, possibly with a tool (for example, a screwdriver), to the lower surface of the upper wall 80, the upper surface of the bottom wall 81, the front surface of the bottom wall 82 and to the inner surface of the side wall 82'.

Moreover, the box-shaped element may include two plate-shaped elements 87, 88 for attaching the movable hinge body 10 to the wall, preferably with screws or dowels to be inserted in the housings 89', 89".

The front surface of the plate-shaped elements 87, 88 is susceptible to remain flush with the door and accessible once the hinge body 10 is concealed therein.

In a preferred but not exclusive embodiment, shown in FIGS. 8 to 12*d*, the first box-shaped element 12 may comprise means for adjusting the sliding of the second inner element 12" with respect to the first outer element 12' along a plane substantially parallel to the axes X and Y, so as to adjust the distance and/or the inclination of the door with respect to the wall.

Suitably, the adjustment means may comprise a pair of actuator elements 212', 212" to be controlled by a user which are located at opposite end portions 213', 213" of the second inner element 12".

Each of the actuator elements 212', 212" may be configured so that the rotation thereof imparted by the user corresponds to the sliding of the end portions 213', 213" along a direction d" substantially parallel to the axis Y.

The two actuator elements 212', 212" may be equal to each other. Therefore, hereinafter it is described only one of them, it being understood that the other has the same configuration.

The actuator element 212" may include a pin 214 having a first threaded portion 215' engaged in a corresponding counter-threaded seat 12'" of the first outer element 12' and a second portion 215" integrally coupled with a control element 216. More particularly, the latter and the pin 214 may be rotationally blocked relative to one another, for example by a plug or a suitable shaping with mutually engaged flat portions, and may be mutually coupled by means of a blocking element 217 adapted to mutually blocking relative to each other the second threaded portion 215", the end portion 213" of the second inner element 12" and the same control element 216.

Therefore, the end portion 213" of the second inner element 12" is interposed between the second threaded portion 215' and the control element 216.

Moreover, this is rotationally controlled from the outside by a user so that the rotation of the same control element 216 corresponds to the rotation of the pin 214. As a consequence, the user by doing so can adjust the relative position of the door with respect to the wall, in terms of distance and/or inclination.

Moreover, thanks to the above configuration, the mounting is extremely simplified. It is in fact sufficient to insert the pin 214 into the counterthreaded seat 12'", to insert the second inner element 12" into the first outer element 12' by placing the end portion 213" at the second threaded portion 215', to insert the control element 216 of the latter and block the assembly by means of the blocking element 217.

In the embodiments of the hinge 1 shown in the FIGS. 1 to 13 the tubular element 11 may internally include a working chamber 13, which may in turn include means 40 for the automatic closing of the closing element once opened, and means 50 for the hydraulic damping of the pivotal movement of the movable hinge body 10.

The embodiment of the hinge 1 shown in FIGS. 14 and 15 is practically equal to the one shown in FIGS. 8 to 12*c*, with the exception that the former does not include the tubular element with the hydraulic damping means 50 and/or the means 40 for the automatic closing of the closing element once opened. In other words, the embodiment of the hinge 1 shown in FIGS. 14 and 15 is a mechanical connecting hinge for rotatably moving the door D.

Suitably, the means 40 for the automatic closing of the closing element after opening can be defined by elastic counteracting means, for example a coil spring.

Moreover, the means 50 for the hydraulic damping of the pivotal movement of the movable hinge body 10 may advantageously include a plunger member 51 sliding along the axis Y and a working fluid, such as oil, hydraulically acting thereon.

It is understood that the hinge 1 may also be free of automatic closing means 40, thus being a hydraulic checking hinge or hydraulic brake. In this case, elastic counteracting means adapted to restore the initial position of the plunger member may be present or not.

The plunger member 51 may be mutually connected with the fixed hinge body 20 so that the rotation of the movable element 10 corresponds to the sliding of the former and vice-versa.

For this purpose, at least one shaft 41 may be provided having a first end 42 operatively connected with the connection assembly 30 and a second end 43 mutually connected with the plunger member 51.

The first end 42 of the at least one shaft 41 may be connected to the connecting assembly 30 via the connecting element 44, the latter being at one end screwed into the end 42 and at the other end connected to the first hook-shaped arm 31 by means of the first pin 32'.

To allow the connection between the at least one shaft 41 and the connecting element 44, the first end 42 of the former can pass through a central opening 83 of the bottom wall 82 of the box-shaped element 12.

As better explained below, the second end 43 may be screwed onto the plunger member 51.

Figures 10A, 10B, 10C:
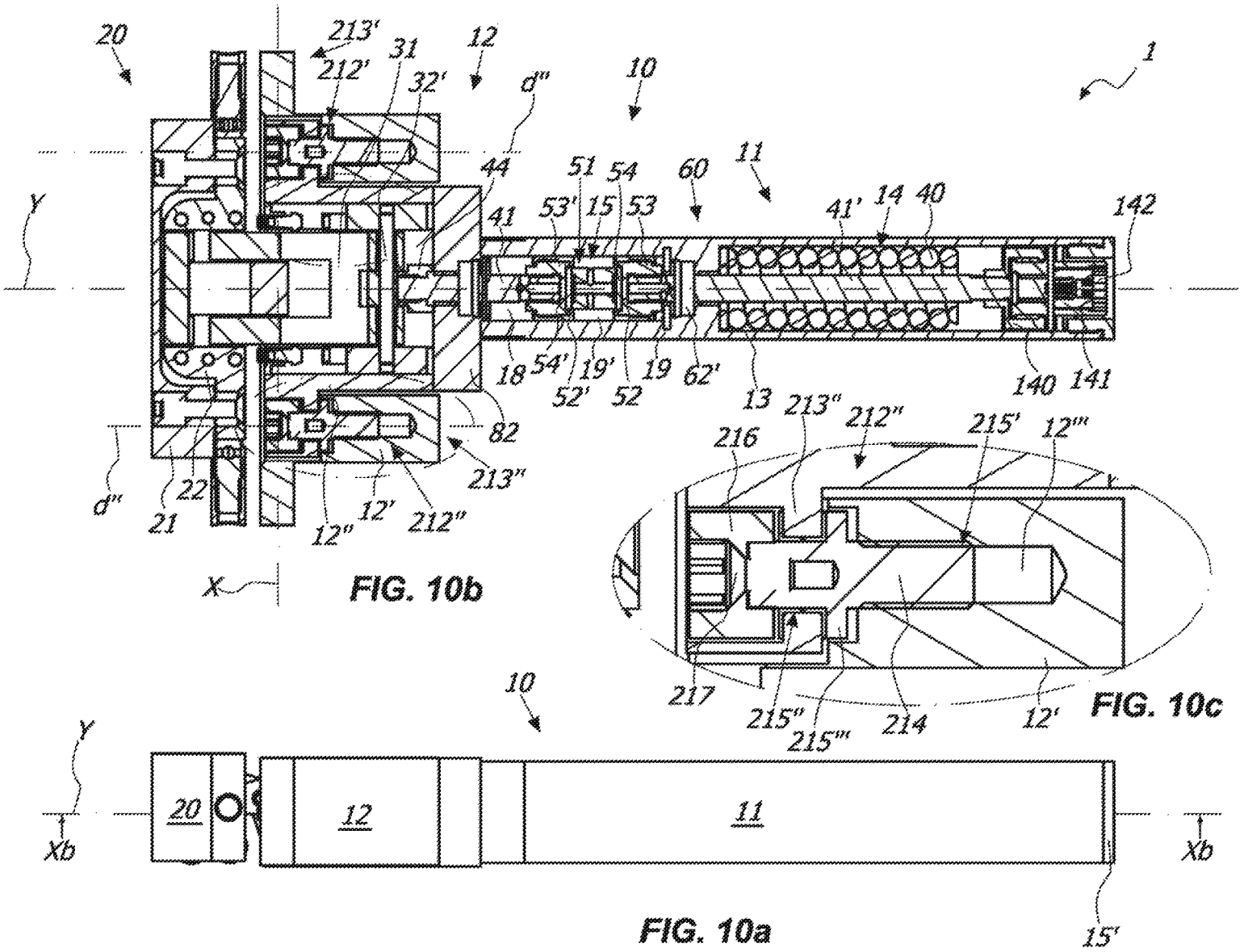
FIGS. 10*a* and 10*b* are views respectively top in the closed position and sectioned along a plane Xb-Xb of the embodiment of the hinge 1 of FIG. 8, with in FIGS. 10*c* and 10*d* some enlarged details of FIG. 10*b;*
Figure 10D:
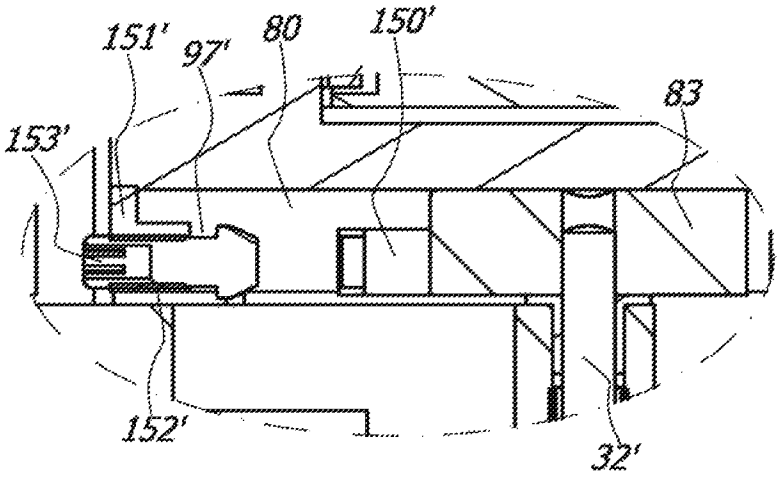

The coil spring 40 can be fitted over the at least one shaft 41. In particular, the former can be fitted over the at least one shaft 41 so as to be in a position of maximum elongation when the movable hinge body 20 is in the door closed position, such as shown in FIGS. 2*b* and 10*b*.

In order to functionally split the means 40 for the automatic closing of the closing element once opened and the means 50 for the hydraulic damping of the pivotal movement of the movable hinge body 10, the working chamber 13 may be divided into two half-chambers 14, 15 separated each other by separation means 60.

Advantageously, the separation means 60 may include a pair of seal 62', 62" so that the working fluid lies exclusively in the second half-chamber 15, the first half-chamber 14 remaining dry.

In this way, it is possible to use a spring 40 greatly longer (and hence having more force) than the one which could have been inserted in the limited space of the half-chamber 15.

Suitably, the first half-chamber 14 may include means 40 for the automatic closing of the closing element once opened, while the second half-chamber 15 may include the hydraulic damping means 50. More particularly, the second half-chamber 15 may include the plunger member 51, the working fluid and at least one non-return valve which includes a respective at least one control member 52, for example of the butterfly type, and at least one end element 53.

The at least one control member 52 may be movable within a respective at least one seat 54 which is defined when the plunger member 51 and the at least one end element 53 are engaged with each other. In other words, at least one of the front or rear surfaces of the plunger member 51 and the front surface of the at least one end element 53 are suitably configured so as to define the at least one seat 54 for the at least one control member 52.

Such details are described in detail later.

In a preferred but not exclusive embodiment, shown in FIGS. 1 to 7*c*, the first half-chamber 14 may be proximal to the axis X and/or to the first box-shaped element 12, while the second half-chamber 15 may be distal therefrom.

In this case, the shaft 41 may be a single shaft placed in both the half-chambers 14 and 15. More particularly, the shaft 41 may have the first end 42 protruding from the first half-chamber 14 through the free end 16 for connection with the connecting element 44 and the second end 43 passing through the separation means 60 to lie within the second half-chamber 15.

The coil spring 40 can be fit onto the single shaft 41 at the second end 46.

The separation means 60 may include a radial appendix 61 extending radially towards the inner side of the working chamber 13 susceptible to abut against a radial appendix 45 of the shaft 41 which extends radially outwardly with respect to the second axis Y. More particularly, the radial appendix 45 of the shaft 41 may include a front surface 46 susceptible to come into contact with the spring 40 and a rear surface 47 susceptible to come into contact with the radial appendix 61 to act as end-stroke for the shaft 41.

In another preferred but not exclusive embodiment, shown in FIGS. 8 to 12*d*, the second half-chamber 15 may be proximal to the axis X and/or to the first box-shaped element 12, while the first half-chamber 14 may be distal therefrom.

In this case, a first shaft 41 placed exclusively within the second half-chamber 15 and a second shaft 41' placed within the first half-chamber 14 and the second half-chamber 15 may be provided.

The second shaft 41' may have a third end 42' operatively connected with the plunger member 51 and a fourth end 43' lying in the first half-chamber 14. The coil spring 40 may be fitted onto the second shaft 41'.

Conveniently, the latter may include means for adjusting the preload of the coil spring 40 including a slider 140 slidable along the second shaft 41' to act on the coil spring 40 and an actuator element 141 acting on the slider 140 to promote the sliding thereof in response to a rotation of the same actuator element 141 imparted by the user.

To do this, the actuator element 141 can be accessed from the outside by the same user, for example by means of a tool with a shaped head inserted in a control counter-shaped portion 142 of the actuator element 141. In a preferred but not exclusive embodiment, this shaped head may for example be hexagonal.

In order to preload the coil spring 40, the slider 140 may be rotationally blocked, for example by one or more pins or by means of prismatic kinematic pairs, in particular two or more pairs of mutually engaged flat surfaces.

Suitably, pins or prismatic kinematic pairs also act as guide means of the slider 140 along the second shaft 41'.

The actuator element 141 may further be screwed on/unscrewed from the second shaft 41' and idly coupled with the slider 140 so that the screwing/unscrewing of the former imparted by the user for example by means of the above shaped head tool corresponds to the sliding of the slider 140.

Advantageously, the plunger member 51 may divide the second half-chamber 15 into two variable volume compartments 18, 19, fluidically communicating with each other and reciprocally adjacent.

Suitably, when the movable hinge body 10 is in the closed door position the first variable volume compartment 18 may have the maximum volume and the second variable volume compartment 19 may have the minimum volume. On the other hand, when the movable hinge body 20 is in the open door position the first variable volume compartment 18 may have the minimum volume and the second variable volume compartment 19 may have the maximum volume.

Therefore, upon the opening of the closing element the working fluid passes from the first variable volume compartment 18 to the second variable volume compartment 19. To this end, in a first embodiment of the invention shown in FIGS. 1 to 7*c*, a first line 55 for the fluidic connection of the compartments 18, 19 passing through the end element 53, the seat 54, the plunger member 51 and the second end 43 of the shaft 41 may be provided.

Figure 13:
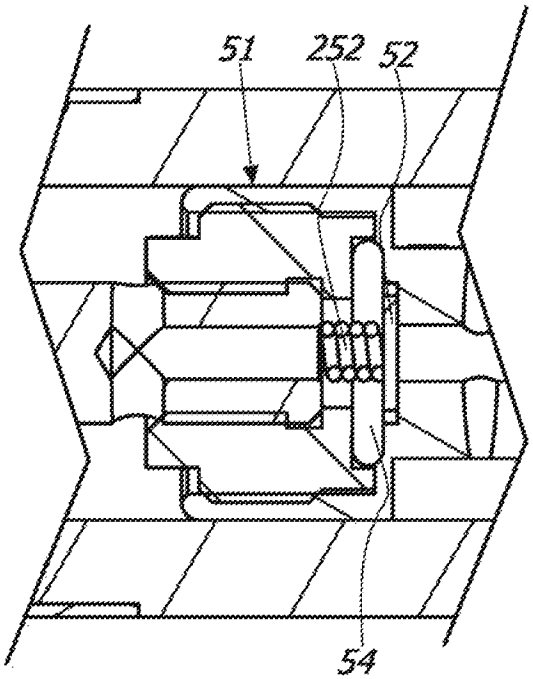
FIG. 13 is a sectional view of some details of a further embodiment of the hinge 1.

In a preferred but not exclusive embodiment, shown in FIG. 13, a spring 252 acting on the at least one control member 52 for forcing the closing thereof against the at least one seat 54 may be provided, so as to minimize the closing time of the at least one valve and to have an optimal control on the closing element.

The separation means 60 may be configured so that each of the half-chambers 14, 15 is accessible only through the respective free end 16, 17.

Therefore, the at least one end element 53, the at least one control member 52 and the plunger member 51 can be inserted within the second half-chamber 15 through the free end 17.

To allow an operator to mount/dismount the at least one control member 52 in/from the at least one seat 54 which is formed by coupling the at least one end element 53 and the plunger member 51 outside the second half-chamber 15 and then insert the unitary assembly thus formed in the same second half-chamber 15 the at least one end element 53 and the plunger member 51 may be removably coupled. To do this, the plunger member 51 may include a threaded rear seat 56 adapted to receive the at least one end element 53, which may have a peripheral counter-threaded area 57.

To allow the operator to mount the unitary assembly of the at least one end element 53, the at least one control member 52 and the plunger member 51 which has been previously formed onto the single shaft 41 in the case of the embodiment shown in FIGS. 1 to 7*c* and the second shaft 41' in the case of the embodiment shown in FIGS. 8 to 12*d*, the plunger member 51 and the latter may also be removably coupled.

To this end, the second end 43 of the shaft 41 or the third single end 42' of the second shaft 41' may be threaded, while the plunger member 51 may include a corresponding counter-threaded seat 58.

In this way, it is possible to mount in a simple and fast manner the unitary assembly of the at least one end element 53, the at least one control member 52 and the plunger member 51 on the single shaft 41 or on the second shaft 41' without the aid of screws or similar fastening elements.

To allow the operator to control the unitary assembly between of the at least one end element 53, the at least one control member 52 and the plunger member 51 once inserted within the second half-chamber 15, in the embodiment shown in FIGS. 1 to 7*c* the end element 53 may include an elongated appendix 59 projecting from the free end 17. In this way, the operator is extremely facilitated in its task.

Suitably, the elongated appendix 59 may have a volume substantially equal to the volume of working fluid that passes between the first variable volume compartment 18 and the second variable volume compartment 19. In this way, it is possible to avoid imbalances and overpressure between the two compartments upon the passage of the fluid.

In a preferred but not exclusive embodiment, the second half-chamber 15 may be closed by a cap 15'.

In this case, the elongated appendix 59 may be configured to pass through the cap 15', and may have a control end 59' accessible by the operator to enable it mounting the unitary assembly of the end element 53, the control member 52 and the plunger member 51 on the shaft 41 with the cap 15' inserted within the second half-chamber 15.

To do this, the cap 15' may have a central through hole 15" acting both as a seat for the elongated appendix 59 and as a guide for the sliding thereof along the axis Y. The control end 59' may be accessible through the center hole 15".

In this embodiment, the unitary assembly may include a single end element 53 and a single control member 52 in addition to the plunger member 51.

On the other hand, in the second embodiment shown in FIGS. 8 to 12*d*, the unitary assembly in addition to the plunger member 51 may include a pair of non-return valves with a pair of control members 52, 52' movable in respective seats 54, 54' and a pair of end elements 53, 53'. Among the latter may be interposed a third variable volume compartment 19', the function of which will be clear later.

In this embodiment, the control members 52, 52' act in opposite directions, so that upon one of the opening or closing of the door one of the control members 52 opens and the other control member 52' closes, so that the working fluid flows selectively through only one of them during both the opening or the closing of the door.

Moreover, in this embodiment the unitary assembly of the end elements 53, 53', the control members 52, 52' and the plunger member 51 can be inserted within the second half-chamber 15 and controlled during coupling with the second shaft 41' by means of the first shaft 41, on which the unitary assembly is mounted in advance.

As mentioned above, upon opening of the door the working fluid may pass from the first compartment 18 to the second compartment 19, while upon closing of the same door the working fluid may return from the second compartment 19 to the first compartment 18.

In the first embodiment shown in FIGS. 1 to 7*c*, the two variable volume compartments 18 and 19 are adjacent. In this case, the working fluid during the opening can pass through a fluid connection line 55 passing through the plunger member 51, while during the closing the working fluid may pass through another fluid line 70 different from the first one which passes through a channel made within the wall 11' of the tubular element 11.

As mentioned above, in the second embodiment shown in FIGS. 8 to 12*d* a third compartment 19' may be interposed between the two variable volume compartments 18, 19. In this case, the working fluid may pass through the plunger member 51 and the fluid line 70 passing through the wall 11' of the tubular element 11 both during opening and during closing of the door. In particular, the working fluid passes always through one of the control members 52, 52' and through the third compartment 19'.

In any case, the fluid connection line 70 may include a pair of channels 71, 72 passing through the wall 11' of the tubular element 11 at the second half-chamber 15.

Figures 6A, 6B, 6C, 6D:
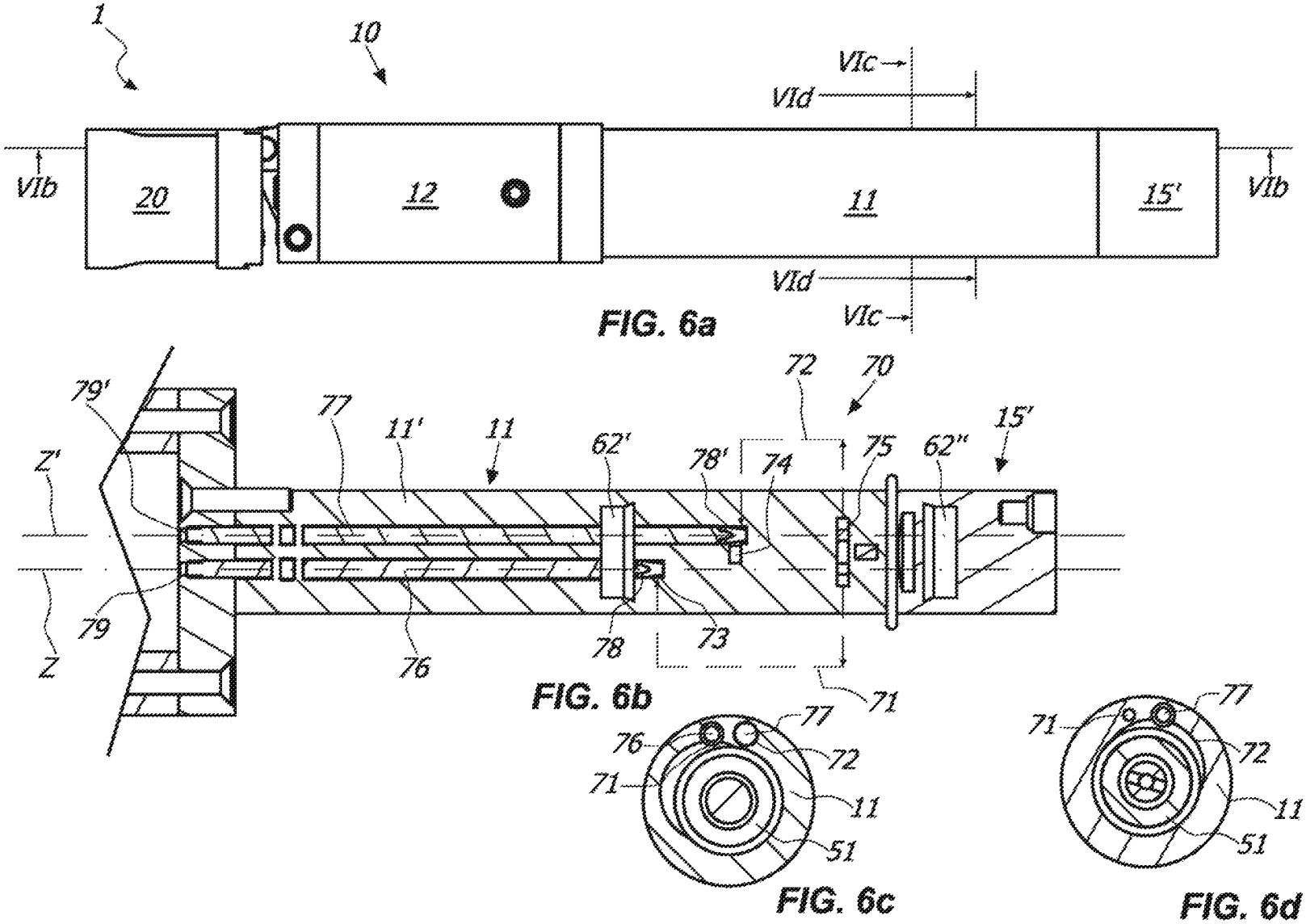
FIGS. 6*a*, 6*b*, 6*c* and 6*d* are views respectively top, partially sectioned according to a plane VIb-VIb and sectioned along planes VIc-VIc and VId-VId of the embodiment of the hinge 1 of FIG. 1.

To allow an easy understanding, in FIG. 6*b* the two channels 71, 72 have been depicted with dotted lines.

To allow the connection between the two compartments 18, 19, the channels 71, 72 may have a respective first and second opening 73, 74 in the first compartment 18 or fluidically communicating therewith, and a third and fourth opening 75, 75" in the second compartment 19. Both openings 75, 75" are placed along the same peripheral groove 175 of the second compartment 19.

The channel 71 may be in fluid communication with the channel 72 through the peripheral groove 175.

Suitably, the first opening 73 can be fluidically decoupled from the plunger member 51 during the entire stroke thereof.

On the other hand, the second opening 74 may be fluidically coupled with the plunger member 51 for a first part of the stroke thereof and fluidically decoupled from the same plunger member 51 for a second part of the stroke thereof.

Therefore, upon closing of the closing element as the plunger member 51 moves the working fluid which is in the second compartment 19 passes through the third and fourth openings 75, 75" in the channels 71 and 72. From the latter, the working fluid arrives in the first compartment 18 through the two openings 73, 74. In the preferred but not exclusive embodiment shown in FIGS. 8 to 12*d*, the two openings 73, 74 are placed at the third compartment 19', from which the working fluid reaches the first compartment 18 through the plunger member 51.

For the first part of the stroke of the plunger member 51, that is until the latter and the second opening 74 are fluidically coupled, the working fluid flows only through the first opening 73. For the second part of the stroke of the plunger member 51, that is when the latter and the second opening 74 are fluidically decoupled, the working fluid flows through both the first opening 73 and the second opening 74. Advantageously, the latter may be placed so as to remain fluidly decoupled from the plunger member 51 for a small part of the stroke thereof, corresponding to a residual rotation of the closing element of 10°-20°.

The sudden flowing of a greater amount of working fluid in the first compartment 18 causes the snap-on forwarding of the plunger member 51, with consequent latch of the closing element towards the closed position.

To allow adjustment of both the speed and the latch of the closing element, a pair of adjusting elements 76, 77 may be provided passing through the bottom wall 82 of the box-shaped element 12 and the wall 11' of the tubular element 11.

Each adjustment element 76, 77 may define a respective axis Z, Z' substantially parallel to the axis Y and perpendicular to the axis X, and may have a length sufficient to reach the respective channel 71, 72.

More particularly, each adjustment element 76, 77 may include a first operating end 78, 78' in correspondence of the respective channel 71, 72 to adjust the flow of the working fluid which flows through the same and a second control end 79, 79' at the bottom wall 82 of the box-shaped element 12 to allow a user to access thereon through the same box-shaped element 12.

In this way, it is possible to regulate the flow of the working fluid which flows through the channels 71, 72 according to need, even when the hinge 1 is mounted and the movable hinge body 10 is concealed within the door.

The adjustment element 76 which acts on the channel 71 adjusts the closing speed of the movable hinge body 10, while the adjustment element 77 regulates the latch of the movable hinge body 10 towards the door closed position.

Figure 12D:
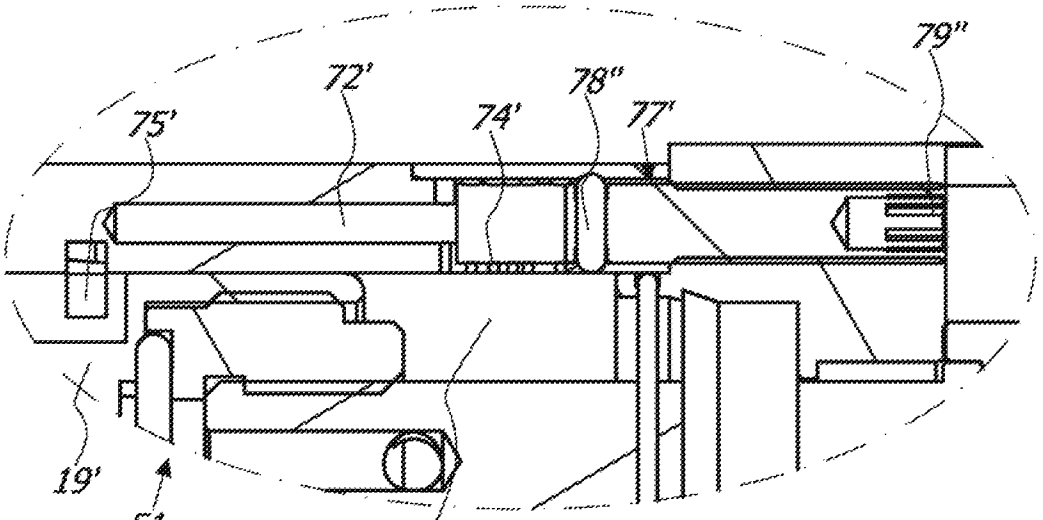
FIGS. 12*a*, 12*b* and 12*c* are views respectively sectioned along planes XIIa-XIIa, XIIb-XIIb and XIIc-XIIc in FIG. 11 of the embodiment of the hinge 1 of FIG. 8, with in FIG. 12*d* some enlarged details of FIG. 12*c;*
Figure 12A:
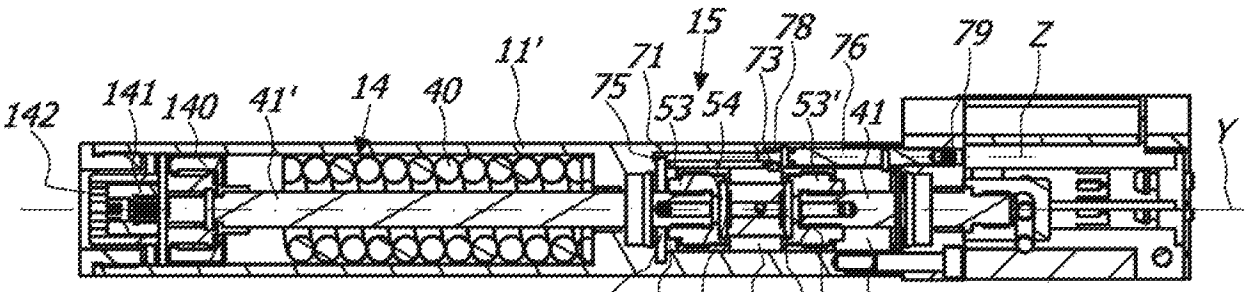
Figure 12B:
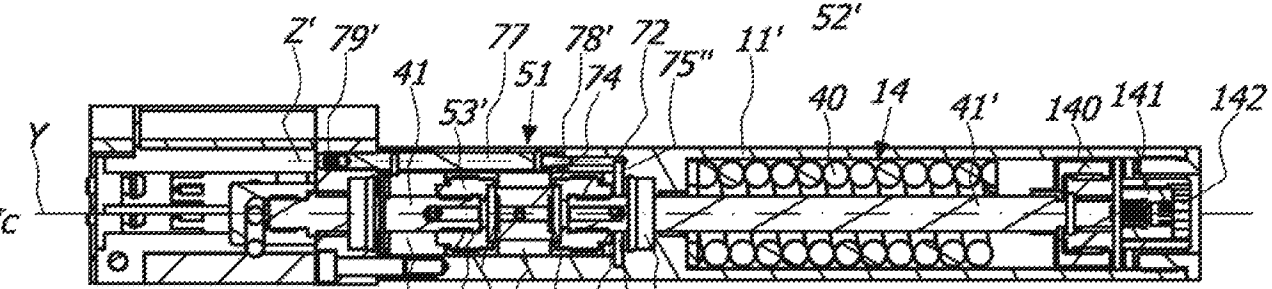
Figure 12C:
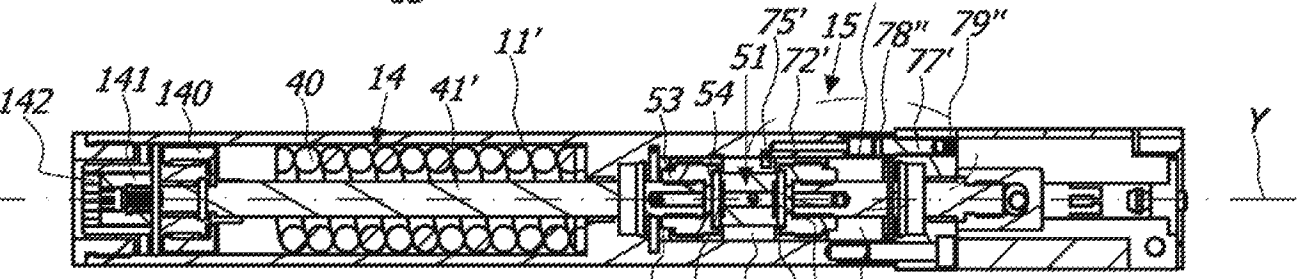
Figure 11:
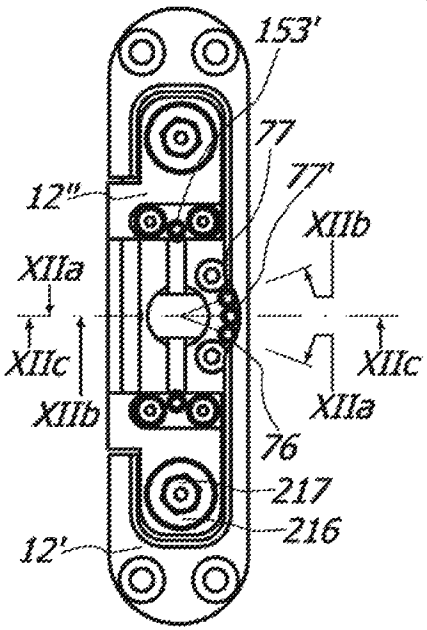
FIG. 11 is a front view of the embodiment of the hinge 1 of FIG. 8.
Figure 16:
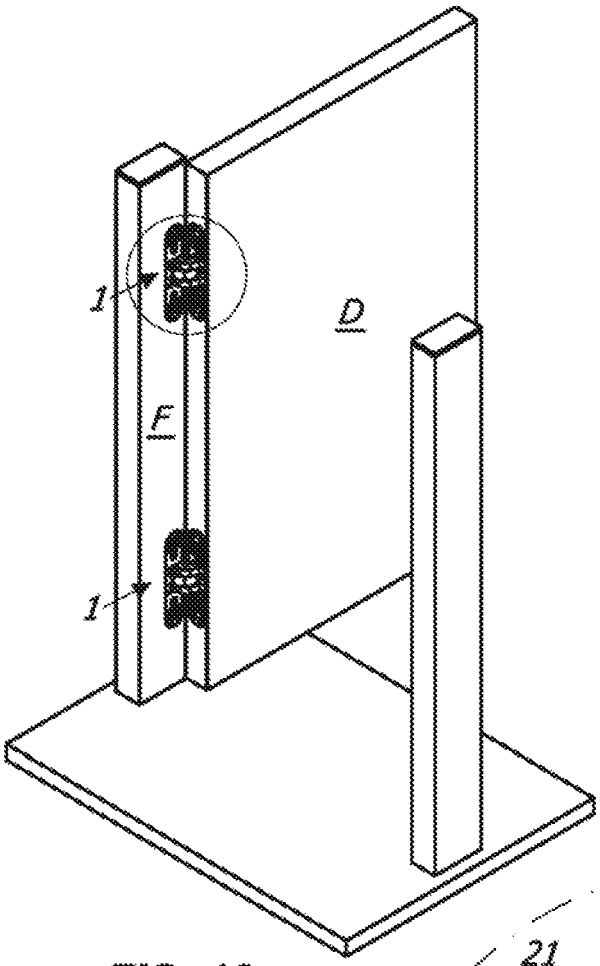
FIG. 16 is a schematic axonometric view of the hinge 1 mounted on a door D and a frame F, with in FIG. 16*a* some enlarged details.
Figure 16A:
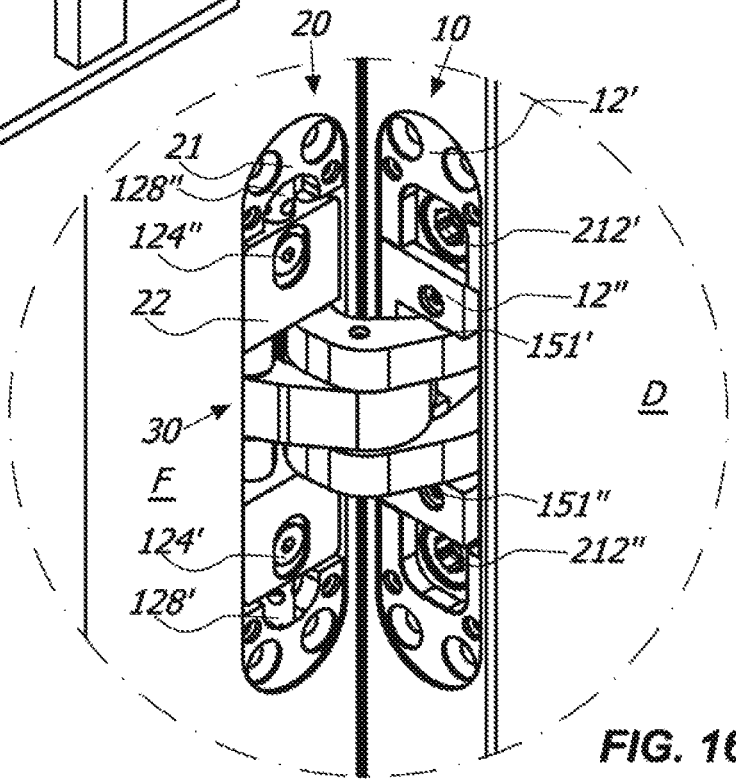
Figure 17A:
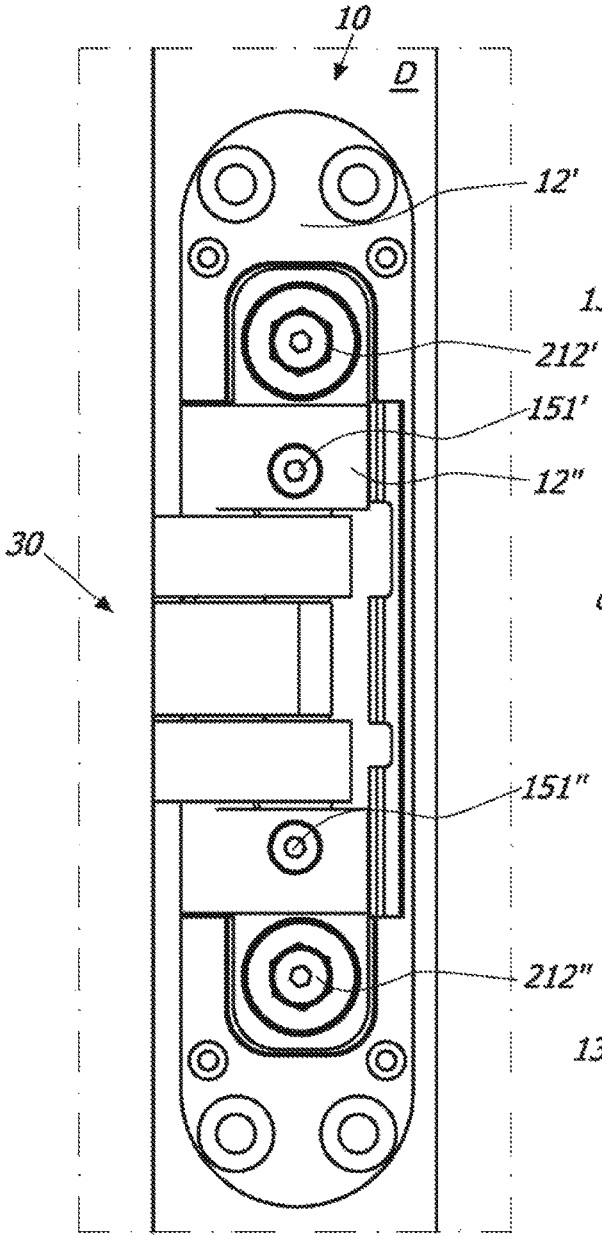
FIGS. 17*a* and 17*b* are front views of respectively the movable hinge body 10 and the fixed hinge body 20 of the hinge 1.
Figure 17B:
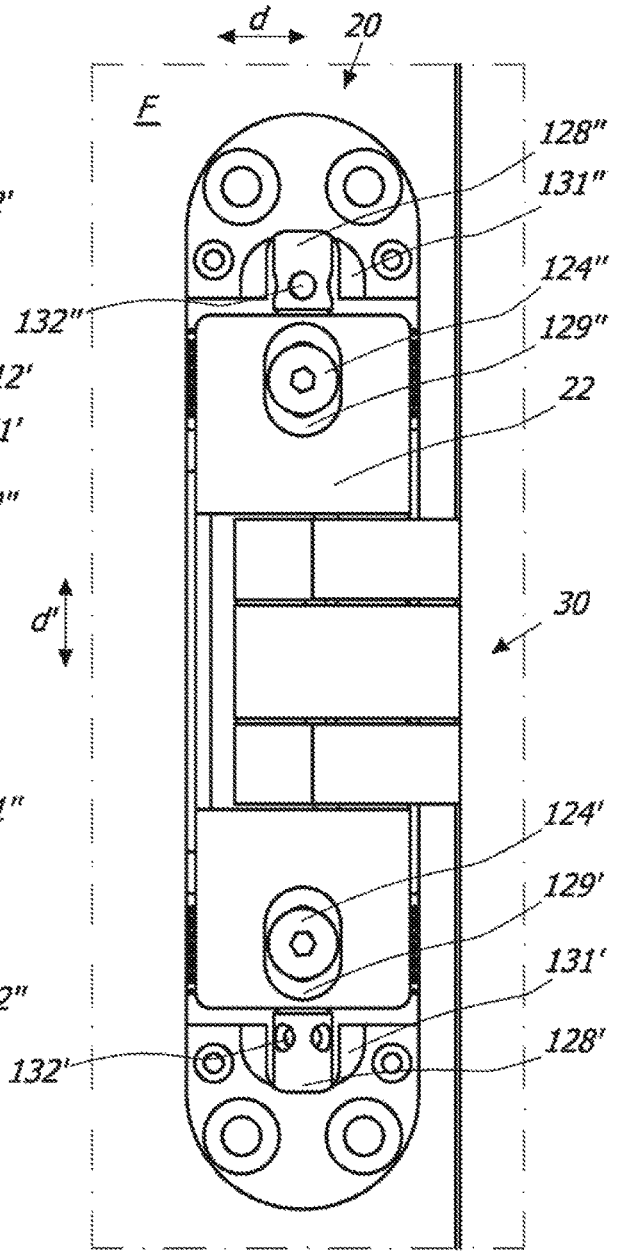

In the second embodiment shown in FIGS. 8 to 12*d*, a third channel 72' may be further provided, shown particularly in FIGS. 12*c* and 12*d*, passing through the wall 11' of the tubular element 11 in correspondence of the second half-chamber 15.

The third channel 72' may have a plurality of fifth openings 74' in the first compartment 18 and one other opening 75' fluidly communicating with the second compartment 19 through the third compartment 19'.

In this way, during the opening of the door control member 52 may be in the closed position, so that the working fluid is forced to pass through openings 74' within the channel 72'. Hence, the working fluid flows in the third compartment 19' through the opening 75'. The control member 52' can be open, so that the working fluid can pass through it in the second compartment 19.

During the closing of the door the control member 52' can pass in the closed position, so that the working fluid which lies in the second compartment 19 is forced to pass through the openings 75, 75" within the channels 71, 72. Hence the working fluid reaches the third compartment 19' through the openings 73, 74, according to what has been described above. The control member 52 can be open, so that the working fluid can pass through it in the first compartment 18.

Advantageously, a third adjustment element 77' may be provided having a respective control end 79" at the bottom wall 82 of the first box-shaped element 12 and an operating end 78'" susceptible to selectively obstruct one or more of openings 74'.

In this way, it is possible to hydraulically limit the opening angle of the door. Depending on the number of openings 74' obstructed/free by the operating end 78'" of the third adjustment element 77', it is possible to vary the opening angle of the door.

Depending on the configuration and/or the mutual distance between the openings 74', the adjustment is more or less fine. For example, the adjustment is by steps, for example of 10° for each opening 74'.

Similarly to the other two adjustment elements, the third adjustment element 77' may be accessible from the outside by a user, for example through a screwdriver.

It is understood that the hinge 1 in any hydraulic configuration may include only one of the channels 71, 72 or 72', as well as couples thereof (71 and 72, 71 and 72', 72 and 72') without departing from the scope of protection of the appended claims. It is further understood that the working fluid can pass through the channels and/or the plunger member in the other direction (for example, it may pass through the channels 71, 72 during opening and through the channel 72' during closing of the closing element) without departing from the scope of protection of the appended claims.

As mentioned above, the connection assembly 30 is configured to lie within the first box-shaped element 12 when the movable hinge body 10 is in the closed door position and to extend therefrom when the same movable hinge body 10 is in the open door position.

To this end, the top wall 80 and the bottom one 81 of the box-shaped element 12 may include a pair of sliders 83, 84 sliding in respective guides 85, 86 substantially parallel to the axis Y facing to each other. The first pin 32', in addition to mutually connect the first hook-shaped arm 31 with the shaft 41 via the connecting element 44, may pivotally connect the first arm 31 to the sliders 83, 84, at a first end 33' of the same first arm 31. At the other end 33" the first hook-shaped arm 31 may be pivotally connected with the second box-shaped element 22 by means of a second pin 32".

Advantageously, in the embodiment of the hinge 1 shown in the FIGS. 14 and 15 the first pin 32' may pivotally connect the first arm 31 to the sliders 83, 84 without connecting the same first hook-shaped arm 31 with the shaft 41. Moreover, in this embodiment the first arm 31 may be defined by a couple of superimposed arms.

The connection assembly 30 may further include a second substantially "L"-shaped arm 34 having a first end 35' pivotally connected to the box-shaped element 12 by means of a third pin 32'", a second end 35" pivotally connected with a third arm 36 through a fourth pin 32"" and a third intermediate point 35'" is rotatably connected with the first arm 31 by means of a fifth pin 32""".

Advantageously, the first arm 31 may include a recess 31', while the second arm 34 may include a recess 34'.

The connection between the parts mentioned above may be effected in such a way that upon opening of the closing element the first end 33' of the first hook-shaped arm 31 may slide through the sliders 83, 84 along the guides 85, 86 along the axis Y and rotate it around the first plug 32' until the recess 31' impacts against the third pin 32'". At the same time, the second arm 34 can rotate about the third pin 32'" until the recess 34' impacts against the second pin 32".

Depending on the configuration of the recess 34', the hinge 1 may have an opening angle greater or lesser. For example, the embodiments of the hinge 1 shown in FIGS. 2*a* to 4*c* can open of 180°.

Advantageously, the connection assembly 30 may further include a third substantially plate-shaped arm 36 having a first end 37' pivotally connected to the box-shaped element 22 by means of a sixth pin 32""" and a second end 37" pivotally connected with the second end 35" of the second arm 34 by the fourth pin 32"".

The second arm 34 and third arm 36 may be connected to each other so that the rotation of the second arm 34 about the third pin 32'" corresponds to the rotation of the third arm 36 about the fourth pin 32"".

In this way, the movable hinge body 10 can rotate about the first axis X.

In a preferred but not exclusive embodiment, the hinge 1 may have the opening angle which is mechanically adjustable.

To do this, the box-shaped element 12 may include a pair of adjusting screws 90, 91, which can have a respective control end 92', 92" that is accessible by an operator at the front surface 87', 88' of the plate-shaped elements 87, 88 and a respective operating end 93', 93" at the guides 85, 86 to act as end stroke for sliders 83, 84.

Therefore, the operator by acting on the control end 92', 92" moves axially, i.e. along a direction parallel to the axis Y, the screws 90, 91, by at the same moving the end stroke 93', 93" of the sliders 83, 84 and then the opening angle of the closing element.

Figure 7A:
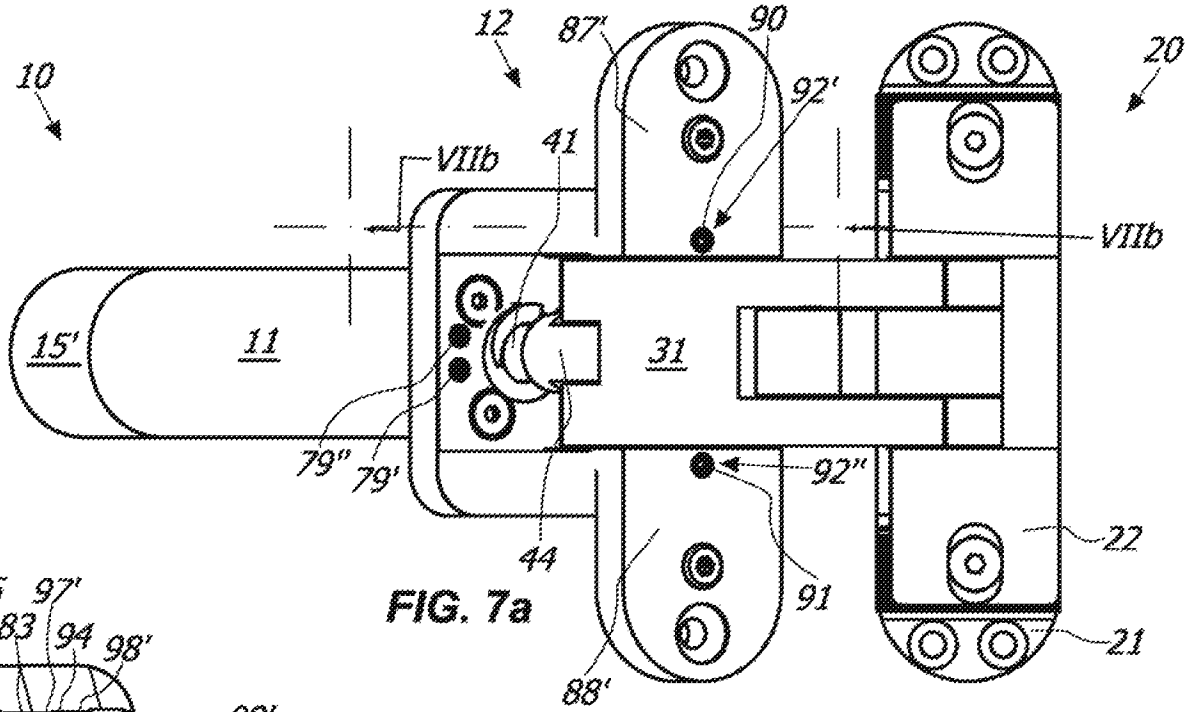
FIGS. 7*a*, 7*b* and 7*c* are views respectively axonometric in the open position and sectioned along a plane VIIb-VIIb and VIIc-VIIc of a further embodiment of the hinge 1.
Figure 7C:
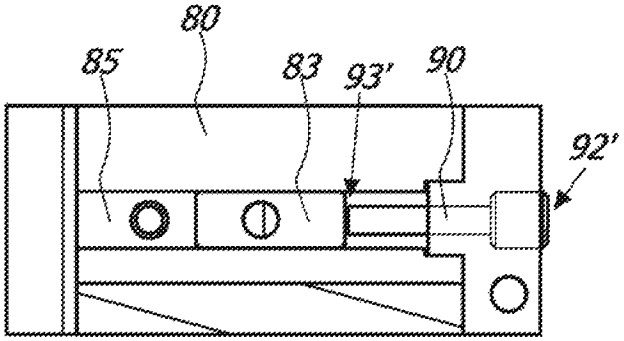
Figure 7B:
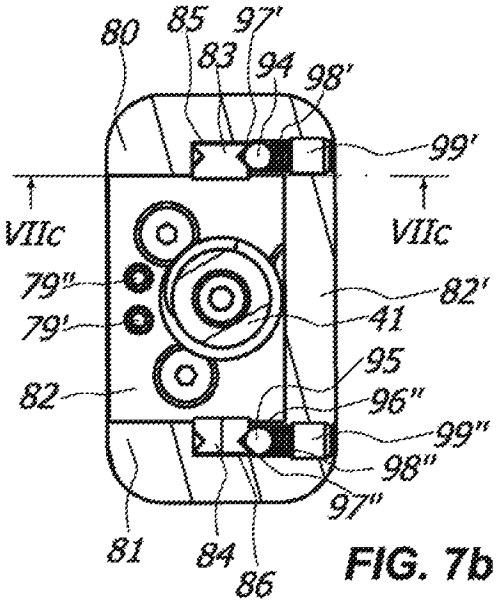
Figure 8:
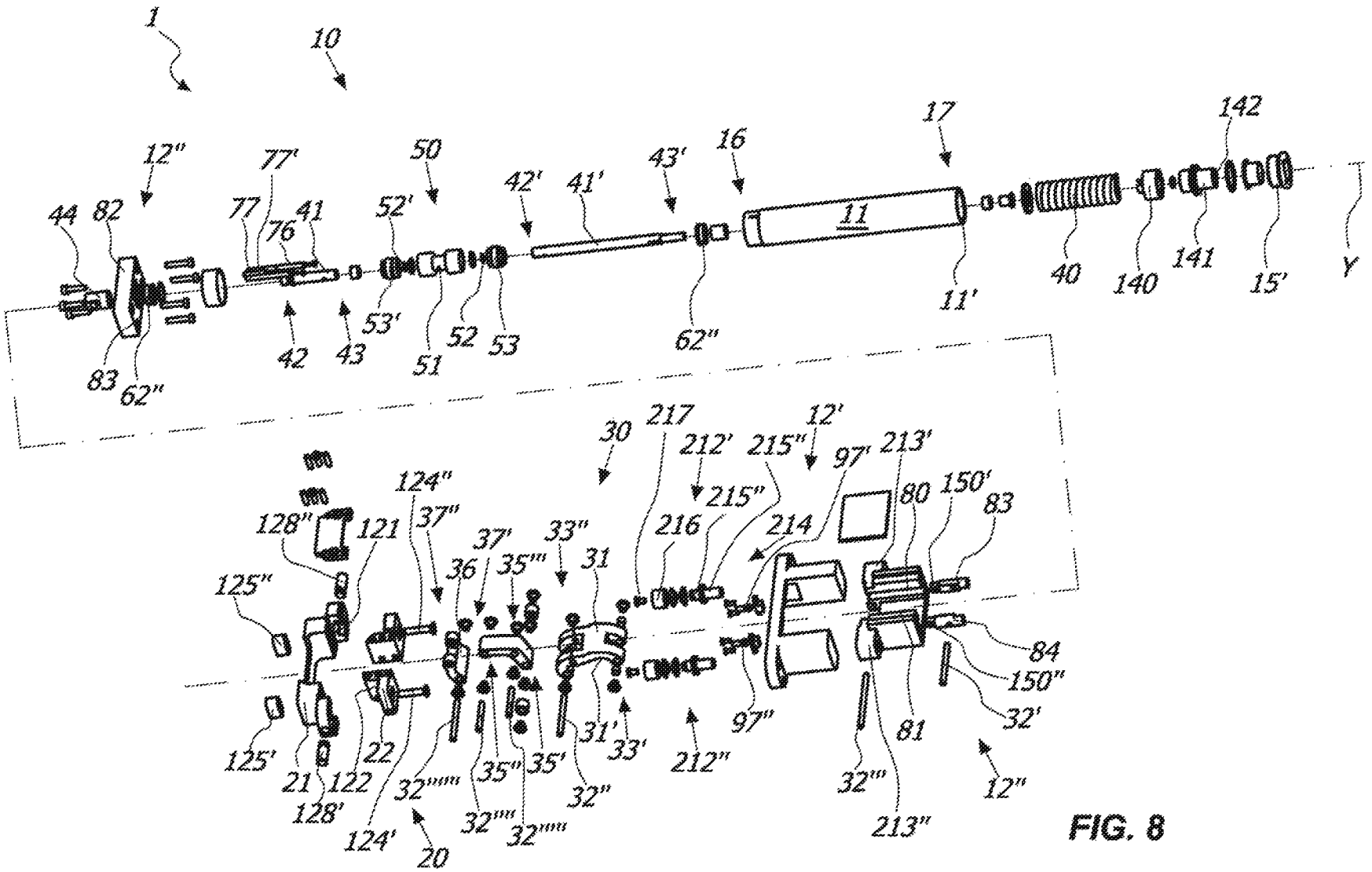
FIG. 8 is an exploded isometric view of a further embodiment of the hinge 1.
Figures 9A, 9B, 9C, 9D:
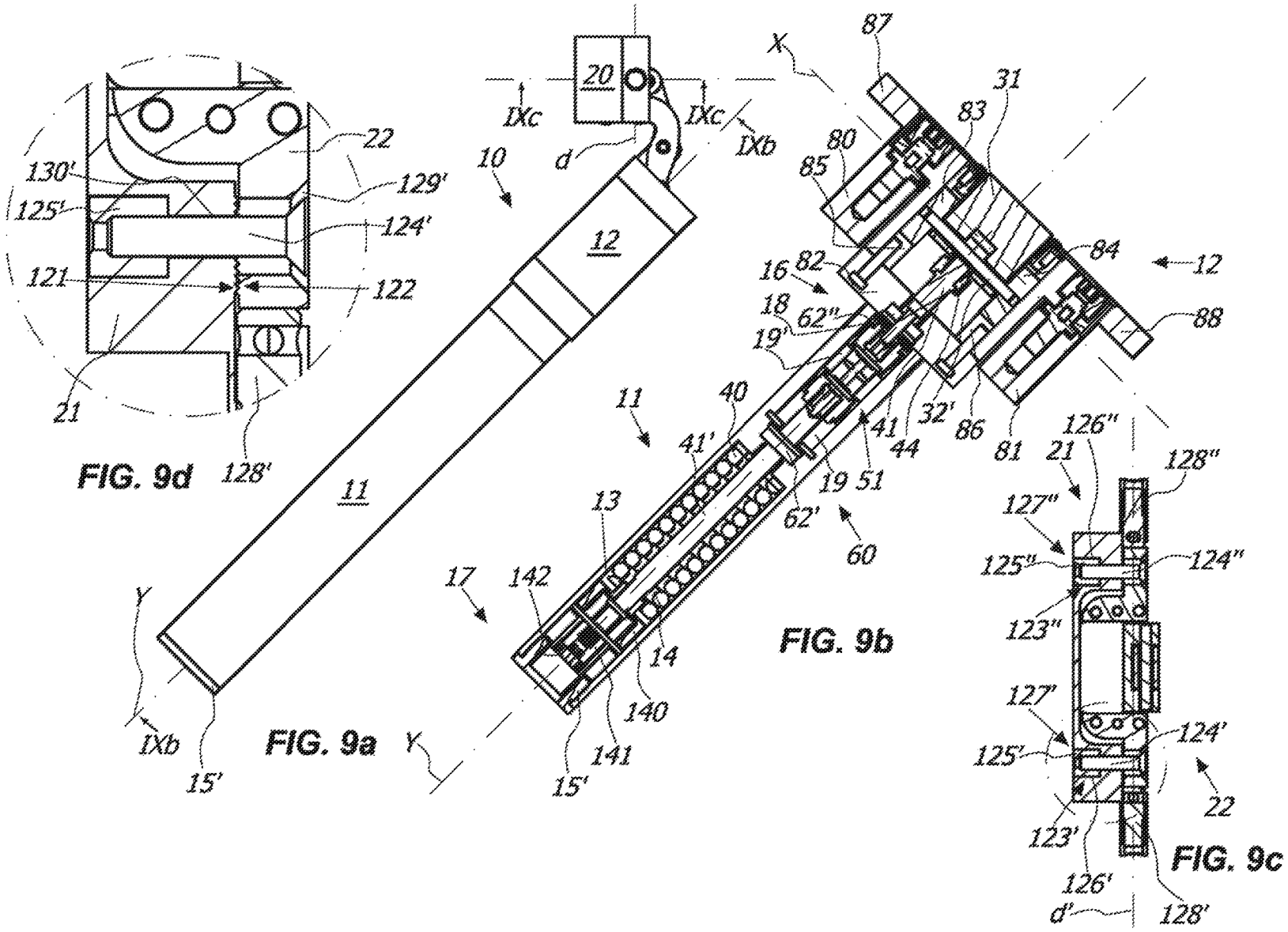
FIGS. 9*a*, 9*b* and 9*c* are views respectively top in the open position and sectioned along a plane IXb-IXb and IXc-IXc of the embodiment of the hinge 1 of FIG. 8, with in FIG. 9*d* some enlarged details of FIG. 9*a;*

Since, as particularly shown in FIG. 7*a*, the front surface 87', 88' of the plate-shaped elements 87, 88 is flush with the door and accessible, the operator may make such adjustment in a simple and rapid manner, by simply opening the door.

It is understood that the box-shaped element 12 may also include a single adjustment screw 90 without departing from the scope of the appended claims.

In a further preferred but not exclusive embodiment, the hinge 1 may have one or more door stop positions, such as the position of maximum opening, or the latter and an intermediate position.

To do this, in the first embodiment shown in FIGS. 1 to 7*c* the box-shaped element 12 may include a pair of releasable engagement elements adapted to engage in corresponding seats 97', 97" formed on the sliders 83, 84.

More particularly, in the first embodiment shown in FIGS. 1 to 7*c* the releasable engagement means may be defined by a pair of balls 94, 95 inserted transversely through the openings 96', 96" passing through the side wall 82' of the box-shaped element 12.

To push the balls 94, 95 into the seats 97', 97" and at the same time to allow the disengagement of the former from the latter, elastic pushing means may be provided acting on the same balls 94, 95, for example springs 98', 98".

Therefore, once the sliders 83, 84 during their sliding along the guides 85, 86 reaches the balls 94, 95, the springs 98', 98" pushes the latter to engage within the respective seats 97', 97", thus stopping the sliding of the sliders 83, 84 and consequently blocking in this position the closing element.

To unblock the door, a user can act thereon to disengage the balls 94, 95 from the corresponding seats 97', 97". To do this, the user has to overcome the force imparted by the springs 98', 98".

To allow presetting of such force, suitable adjustment screws 99', 99" may act on the springs 98', 98" inserted within the passing-through openings 96', 96".

In this way, by turning the adjusting screws 99', 99" the operator can preset the blocking/unblocking force of the closing element, for example according to its weight or to the presence or absence of children in the house.

It is understood that the box-shaped element 12 may include more pairs of balls 94, 95, so as to block the door in several positions, for example in the closed position, the open one and in one or more intermediate positions.

It is further understood that it is also possible to use only one of the balls 94, 95 without departing from the scope of the appended claims.

On the other hand, in the second embodiment shown in FIGS. 8 to 12*d* and the one shown in FIGS. 14 and 15 the releasable engagement means may be defined by a pair of resilient arms 150', 150" unitary with the sliders 83, 84 susceptible to snap-engage in a groove 97', 97" unitary with the first box-shaped element 12.

More specifically, as particularly shown in FIG. 10*b*, the latter may have a pair of abutment elements 151', 151" each comprising a respective groove 97', 97".

To allow a user to mechanically adjust the opening angle of the closing element, each of the abutment elements 151', 151" may be slidably mounted in a respective seat 152', 152". In addition, each of the abutment elements 151', 151" may include one end 153', 153" accessible by a user to adjust the sliding thereof along the seats 152', 152", so as to adjust as needed the point where the resilient arms 150', 150" and grooves 97', 97" mutually engage.

In particular, the abutment elements 151', 151" may be adjusting screws.

In the embodiment shown in FIGS. 8 to 12*d* the seats 152', 152" may belong to respective support plates mounted on the first box-shaped element 12 by suitable screws, whereas in the embodiment shown in FIGS. 14 and 15 the seats 152', 152" may be made directly within the first box-shaped element 12.

Suitably, regardless of the configuration, at least one of the at least one releasable engagement element 94, 95 and at least one seat 97', 97" may be removably fixed to the corresponding first box-shaped element 12, or to the corresponding slider 83, 84. In this way, a user may remove the same to provide a hinge free of stopping points of the closing element, for example for fire doors.

From the above, it is apparent that the hinge according to the invention achieves the intended objects.

The hinge according to the invention is susceptible of numerous modifications and variations, all within the inventive concept expressed in the accompanying claims. All the details may be replaced with other technically equivalent elements, and the materials may be different according to requirements, without departing from the scope of the invention.

Even if the hinge has been described with particular reference to the accompanying figures, reference numbers used in the description and in the claims are merely used to improve the intelligence of the invention and do not constitute any limitation of the claimed scope.

What is claimed is:

1. A concealed hinge for a door comprising:

a fixed hinge body adapted to be anchored to a stationary support structure;

a movable hinge body adapted to be anchored to a closing element;

a connecting assembly for mutual connection of the fixed hinge body and the movable hinge body in such a manner that the movable hinge body rotates with respect to the fixed hinge body about a first axis between an open position and a closed position;

wherein one of the fixed hinge body or the movable hinge body includes a first box-shaped element concealedly insertable within one of the closing element and the stationary support structure, the other of the fixed hinge body or the movable hinge body comprising a second box-shaped element concealedly insertable within the other of the closing element and the stationary support structure, one of the first box-shaped element and the second box-shaped element, which is insertable within the stationary support structure defining a second axis, substantially perpendicular to the first axis;

wherein the connecting assembly protrudes from the first box-shaped element in the open position of the movable element, the first box-shaped element being adapted to internally contain the connecting assembly in the closed position of the movable element;

wherein the second box-shaped element includes a first outer element anchored to the other of the closing element and the stationary support structure and a second inner element placed within the first outer element, the second inner element being movable with respect to the first outer element, a system being provided for blocking or unblocking the movement of the second inner element with respect to the first outer element by mutual engagement, the first outer element including a first guide system for guiding the sliding of the second inner element along a first direction perpendicular to the first axis and the second axis;

wherein the first outer element includes a second guide system for guiding the sliding of the second inner element along a second direction parallel to the first axis and perpendicular to both the second axis and the first direction, the second guide system including two or more adjusting screws placed on opposite sides of the second inner element, the adjusting screws being inserted through the first outer element to interact with the second inner element, in such a manner that the lower of the adjusting screws supports the second inner element during its sliding along the first direction.

2. Hinge according to claim 1, wherein the first outer element or the second inner element includes two or more front apertures corresponding with the adjusting screws to allow an operator to access the adjusting screws when the second box-shaped element is concealedly inserted within the other of the closing element and the stationary support structure.

3. Hinge according to claim 2, wherein each of the adjusting screws includes one or more seats to be engaged by a suitable adjusting tool operated by an operator through the front apertures.

4. Hinge according to claim 1, wherein the first outer element includes a first grooved surface with a plurality of rows defining the first direction, the second inner element including a corresponding second countershaped surface engaged with the first grooved surface, the first grooved surface defining the first guide system, the blocking or unblocking system including the first grooved surface and the second countershaped surface.

5. Hinge according to claim 4, wherein the second guide system is operable by an operator upon mutual disengagement of the first grooved surface and the second countershaped surface, and the first grooved surface and the second countershaped surface are adapted to be mutually reengaged after operation on the first guide system.

6. Hinge according to claim 5, wherein the blocking or unblocking system further comprises a screw element to reciprocally engage or disengage the first grooved surface and the second countershaped surface.

7. Hinge according to claim 6, wherein the screw element includes a screw engageable into an engagement element sliding in an elongated slot which is parallel to the first direction, the elongated slot being placed on a surface opposite to the second countershaped surface.

8. Hinge according to claim 7, wherein the screw is inserted through a first passing-through hole of the second inner element and through a second passing-through hole of the first outer element, the first passing-through hole being an elongated slot parallel to the first axis.

9. Hinge according to claim 1, wherein the first box-shaped element comprises a first outer element adapted to be anchored to one of the closing element and the stationary support structure and a second inner element placed within the first outer element and coupled thereto, the second inner element being movable relative to the first outer element.

10. Hinge according to claim 9, wherein the first box-shaped element comprises means for adjusting the sliding of its second inner element with respect to its first outer element along a plane parallel to the first axis and the second axis, so as to adjust the distance or the inclination of the closing element relative to a bottom wall of said first box-shaped element.

11. Hinge according claim 10, wherein the means for adjusting the sliding includes a pair of actuator elements controllable by a user located in correspondence to opposite end portions of the second inner element of the first box-shaped element, each one of the actuator elements being configured so that the rotation thereof imparted by the user corresponds to the sliding of the relative end portion along a third direction parallel to the second axis.

12. Hinge according to claim 11, wherein each one of the actuator elements includes a first pin having a first threaded portion engaged in a corresponding counterthreaded seat of the first outer element of the first box-shaped element and a second portion integrally coupled with a control element adapted to be rotationally controlled from the outside by a user so that the rotation of the control element corresponds to the rotation of the first pin, the second portion of the first pin including a flange element, the corresponding end portion of the second inner element being interposed between the flange element and the control element.

13. Hinge according to claim 12, wherein the control element and the first pin are rotationally blocked relative to each other and mutually coupled by a blocking element susceptible to mutually block the first threaded portion of the first pin, the end portion of the second inner element of the first box-shaped element, and the control element.

14. Hinge according to claim 12, wherein the connecting assembly includes a hook-shaped arm having a first end rotatably coupled with sliders of the first box-shaped element by the first pin to slide therewith along the guides and a second end rotatably coupled with the movable body hinge by a second pin.

15. Hinge according to claim 14, wherein the connecting assembly further includes an L-shaped arm having a first end rotatably coupled with the first box-shaped element by a third pin, a second end rotatably coupled with the movable hinge body by a fourth pin and a third intermediate point rotatably coupled with the hook-shaped arm by a fifth pin.

16. Hinge according to claim 15, wherein said hook-shaped arm includes a first recess adapted to impact against said third pin upon the rotation of the movable hinge body around said first axis, said L-shaped arm including a second recess adapted to impact against said second pin upon the same rotation, said first box-shaped element, the hook-shaped arm, the L-shaped arm and the movable hinge body being mutually connected so that upon opening of the door said first end of said first arm slides by said sliders through said guides along said second axis and rotates about said first pin until said first recess impacts against said third pin, said L-shaped arm rotating around said third pin until said second recess impacts against said second pin.

17. Hinge according to claim 16, wherein said connection assembly further includes a plate-shaped arm having a first end rotatably coupled with said movable hinge body by a sixth pin and a second end rotatably coupled with said second end of said L-shaped arm by said fourth pin, said L-shaped arm and said plate-shaped arm being mutually connected so that the rotation of the L-shaped arm around said third pin corresponds to the rotation of said plate-shaped arm around said fourth pin, so that said movable hinge body is rotatable about said first axis.

18. Hinge according to claim 1, wherein said first box-shaped element includes a bottom wall which is parallel to said first axis.

* * * * *